United States Patent [19]

de Gelder

[11] Patent Number: 4,867,056

[45] Date of Patent: Sep. 19, 1989

[54] APPARATUS AND METHOD FOR CUTTING INDICIA FROM TAPE

[75] Inventor: J. Becker Anderson, Hermosa Beach, Calif., Jacob de Gelder, Rancho Palos Verdes, Calif.

[73] Assignee: Reynolds/Leteron, Co., Torrance, Calif.

[21] Appl. No.: 211,133

[22] Filed: Jun. 22, 1988

Related U.S. Application Data

[63] Continuation of Ser. No. 895,832, Aug. 12, 1986, abandoned.

[51] Int. Cl.[4] ..... B41F 17/00

[52] U.S. Cl. ..... 101/19; 101/24; 101/32; 226/143; 267/47

[58] Field of Search ..... 101/32, 19, 23, 24; 400/134.5, 608.3; 226/143; 206/409, 411; 267/47; 100/171, 168, 169

[56] References Cited

U.S. PATENT DOCUMENTS

| | | | |
|---|---|---|---|
| 523,642 | 7/1894 | Mendenhall | 100/171 X |
| 2,058,076 | 10/1936 | Glascodine | 267/47 X |
| 2,273,265 | 2/1942 | Heyel | 226/143 |
| 3,065,691 | 11/1962 | Sohn | 226/143 X |
| 3,092,019 | 6/1963 | Van Buskirk | 101/235 X |
| 3,244,095 | 4/1966 | Matthew | 226/143 X |
| 3,548,747 | 12/1970 | D'Amato | 226/143 X |
| 3,673,953 | 7/1972 | Massari | 101/19 |
| 4,077,306 | 3/1978 | Wech | 226/143 X |
| 4,239,399 | 12/1980 | Johnstun | 400/134.5 X |

FOREIGN PATENT DOCUMENTS

| | | | |
|---|---|---|---|
| 46287 | 3/1985 | Japan | 400/608.3 |

*Primary Examiner*—Clifford D. Crowder

*Attorney, Agent, or Firm*—Christie, Parker & Hale

[57] ABSTRACT

An apparatus for cutting indicia from tape. A pair of rollers provided, each with an axis, first and second ends and roller surfaces. Support plates are included for supporting the second ends. Support plates are also included for supporting the first ends whereby the pair of rollers are oriented with the roller surfaces beside each other with parallel axes. The support plates comprise curved spring means having ends for biasing the roller surfaces together with respect to each other and a plate adjuster for separating the ends and for counteracting the biasing of the rollers. A die plate guide may be provided for guiding the die plates used to form the indicia. Tape pullback may also be provided for negative interletter spacing.

24 Claims, 20 Drawing Sheets

+3
(0.225)

+2
(0.135)

+1
(0.070)

STANDARD
0
(0.005)

-1
(-0.060)

-2
(-0.125)

APPARATUS AND METHOD FOR CUTTING INDICIA FROM TAPE

CROSS-REFERENCE TO RELATED APPLICATION

This application is a continuation of application Ser. No. 06/895,832 filed Aug. 12, 1986, now abandoned, and is co-pending with applicants' related application filed simultaneously with application Ser. No. 06/895,832, said co-pending application being entitled TAPE CARTRIDGE FOR INDICIA CUTTING SYSTEM, U.S. Pat. application Ser. No. 06/895,744 filed Aug. 12, 1986, and incorporated herein by reference.

BACKGROUND OF THE INVENTION

1. Field of the Invention

This invention relates to apparatus for cutting indicia from tape and more specifically to a spring-tensioned support plate assembly for a dual roller arrangement for such an apparatus.

2. Description of Related Art

A prior apparatus includes a pair of pressure rollers, the diameter of one of which is slightly different than that of the other, mounted to a metal frame. One roller has a flat in the circumferential surface. The two rollers are geared with respect to each other in a 1:1 ratio. The pressure rollers are made from stainless steel to provide a proper frictional surface for the tape. The use of stainless steel allows some slipping relative to the pressure roller of tape inserted between the rollers while the tape is being pulled between the rollers. The tape is described more fully below. A certain amount of slippage of the tape relative to the roller is desirable so that the tape does not slip relative to the die plate, which causes wrinkling. Preferably the tape slips relative to the pressure roller the same as the die plate slips relative to its adjacent pressure roller.

The frame includes two pairs of upright metal posts, the posts in each pair being side by side and each pair being spaced apart from the other for supporting respective ends of the two rollers. A tightening bolt connects adjacent posts in each pair for tightening down the upright posts a sufficient amount depending on the die plate and tape thicknesses. The adjustment bolt serves to space the rollers sufficiently close and prevent significant separation of the rollers so that pressure developed by the rollers is sufficient to transfer the form of the letter from the die plate to the tape. The spacing is determined by the thickness of the tape, the thickness of the die plate, described below, used to form a character in the tape and the pressure required to be developed in the tape to produce the desired cutting action. The spacing also depends on the extent of spreading of the rollers as the tape and die plate pass in between.

A ratchet drive, including a crank, couples a handle on the crank to the pressure rollers to rotate the pressure rollers when the handle is turned. Assuming die guides support the die plate from below the rollers, the pressure rollers and the crank are geared so that turning of the crank in the forward direction pulls the die plate and tape upward between the rollers for forming an image. A further predecessor machine is described and claimed in U.S. Pat. No. 3,673,953, incorporated herein by reference.

A die plate having cutting lines for forming a character is placed between the rollers and supported and guided by die plate guides formed in the apparatus. A die plate is disclosed and claimed in U.S. Pat. No. 3,490,362, incorporated herein by reference. The die plate transfers pressure created by the pressure rollers through the cutting lines to the lettering tape. The character may be any discrete image such as a letter, number or design but will be assumed for purposes of discussion here to be a letter. The die plate includes drive lugs in the form of ridges formed in the die plate on each side of the letter. The drive lugs effectively increase the thickness of the die plate so that the pressure rollers more firmly grip the die plate. The drive lugs also preload the pressure rollers before cutting of the tape begins. The preloading develops the compressive pressure in the rollers prior to the point where the cutting lines come between the rollers. The die plate also includes a tape in the form of a uniform thickness label extending a given distance above the letter and a given distance below the letter. The label supplies a last increment of thickness of about three thousandths of an inch to the die plate on either side of the letter on the die plate without which the pressure rollers could not develop sufficient pressure to grip the die plate and tape before or after the letter is formed. If the die plate is placed between the rollers such that the label is below the rollers, the tape and die plate will not be pressed and rolled upward between the rollers. If the pressure rollers contact the die plate below the label, the tape and die plate will be advanced no further.

The die plate defines the interletter spacing for adjacent letters. The image spacing is defined by the distance between the leading edge of a given letter and the trailing edge of the letter and is unique for each type of letter. Every letter preferably has a constant post spacing defined by the length of that portion of the label following the trailing edge of the letter. This is the distance after each letter that the pressure rollers continue to pull the die plate and lettering tape upward. That portion of the die plate and the corresponding tape thickness are not sufficient to allow the rollers to continue pulling the tape and die plate upward. As soon as the end of the label is reached, the full gripping action of the pressure rollers is eliminated. Every letter is separated from adjacent letters a minimum distance equal to the post spacing. Each die plate includes a portion of the label in front of the leading edge of the letter. This amount is used to define a prespace according to the exact point on the label the pressure rollers pick up the die plate. If the rollers pick up the die plate closer to the leading edge of the letter, the prespacing will be less than if the rollers pick up the die plate further away. The combination of the post spacing of one letter and the prespacing of the next letter defines the interletter spacing.

The tape can be a three-layer tape such as that described in U.S. Pat. No. 3,558,425, incorporated herein by reference. The tape is suitable for forming any suitable character but will hereafter be called lettering tape. The tape is a three layer bi-axially oriented tape wherein the letter is formed by the cutting lines on a die plate transferring the pressure of the pressure rollers through the top layer without breaching the first layer either fracturing or bursting the second layer and leaving the third layer intact. The tape is mounted to a spool having friction discs such as a slip clutch mechanism for controlling the play out of the tape in response to the pulling force by the pressure rollers on the end of the tape.

The tape and spool are mounted in a bracket in the apparatus. The lettering tape is inserted between the pressure rollers to form, along with the die plate, a letter in the tape as the die plate and tape are pressed and rolled between the rollers. The pressure rollers create pressure on the die plates and tape to transfer the letter from the die plate to the tape.

As the rollers rotate, the tape is advanced through the rollers a given distance. That distance is defined by the spacing of the letter and its pre- and post spacing. The interletter spacing between the letter and the immediately preceding letter is determined by the post spacing of the previous letter and the prespacing of the letter in question. The interletter spacing between the letter and the next succeeding letter is define by the post spacing of the letter and the prespacing of the next succeeding letter, what ever it may turn out to be.

A knob is provided for adjusting the prespacing for the next letter to be formed. This then defines the interletter spacing between the preceding letter and the one about to be formed. The knob increases beyond a given level the starting point at which the die plate is first fully contacted and therefore the amount by which the die plate is pulled between the rollers. The image spacing and the post spacing is a constant for a given letter. As noted at column 5, lines 25 et seq. of the '953 patent, no additional feed mechanism is required over the pressure rollers, tape, and the die plate.

SUMMARY OF THE INVENTION

The apparatus for lettering tape includes a pair of rollers, each with an axis, first and second ends, and roller surfaces. Means are provided for supporting the second ends. Means are also provided for supporting the first ends whereby the pair of rollers are oriented with the roller surfaces beside each other. The rollers are oriented so that their axes are substantially parallel. The supporting means for the first ends comprises spring means having ends for biasing the roller surfaces together with respect to each other. Means are also included for separating the ends and for counteracting the biasing of the rollers.

In one form of the invention, the supporting means are formed as preloaded laminates wherein the ends are separated by a wedge positioned relative to the ends through a bolt. The apparatus preferably includes a D.C. motor for allowing reverse rotation of the rollers to clear the apparatus. The D.C. motor in conjunction with an appropriate circuit in the form of a ground brake system also provides for precise positioning of the rollers when rotation of the rollers is stopped. Preferably, the apparatus is such that die plates may be inserted between the rollers at an angle of 15° with respect to the vertical. Additionally, one roller is preferably slightly less than twice the diameter of the other roller to minimize rocking of the die plate while the image is being formed. A gear ratio of exactly 2:1 is preferred.

In a further embodiment, the apparatus may combine with tape moving means, or tape pull back, for moving the tape in a reverse direction to allow negative spacing between letters. The reverse motion decreases the prespacing by withdrawing part of the tape from between the rollers so that the next letter starts closer to the letter just formed. The tape moving means may be fixed or built in relative to the apparatus or detachable.

The apparatus may also combine with die guides for guiding and supporting a die plate with respect to the rollers. The die guide may be built into the apparatus or may be a disposable die guide that can be replaced when worn. The die guide may also be fixed or detachable.

The apparatus may include means for frictionally engaging the tape to provide proper tension in the tape while the letter is being formed or to keep the tape from unraveling. This may be in the form of an edge for engaging the roll of tape or a friction pad. The engaging means may be fixed in the apparatus or detachable.

Alternatively, the apparatus may include a modular cartridge incorporating the tape pull back, the means for frictionally engaging the tape and the die guide in a single cartridge to be placed in the apparatus. The apparatus may also include a 12 volt DC input jack and a 120 volt AC input jack for providing power and for charging a battery in the apparatus. A foot switch may be included which allows actuation either through the foot switch or a manual actuator. Use of the foot switch also provides for ground braking of the motor through the ground brake system for precise positioning of the rollers.

A safety interlock is preferably provided in the cover so that power to the motor is significantly reduced if the cover is opened and the pressure rollers completely exposed. The rollers then rotate at a decreased rate, allowing for cleaning of the rollers, etc.

DETAILED DESCRIPTION OF THE PREFERRED EMBODIMENTS

Figure 1:
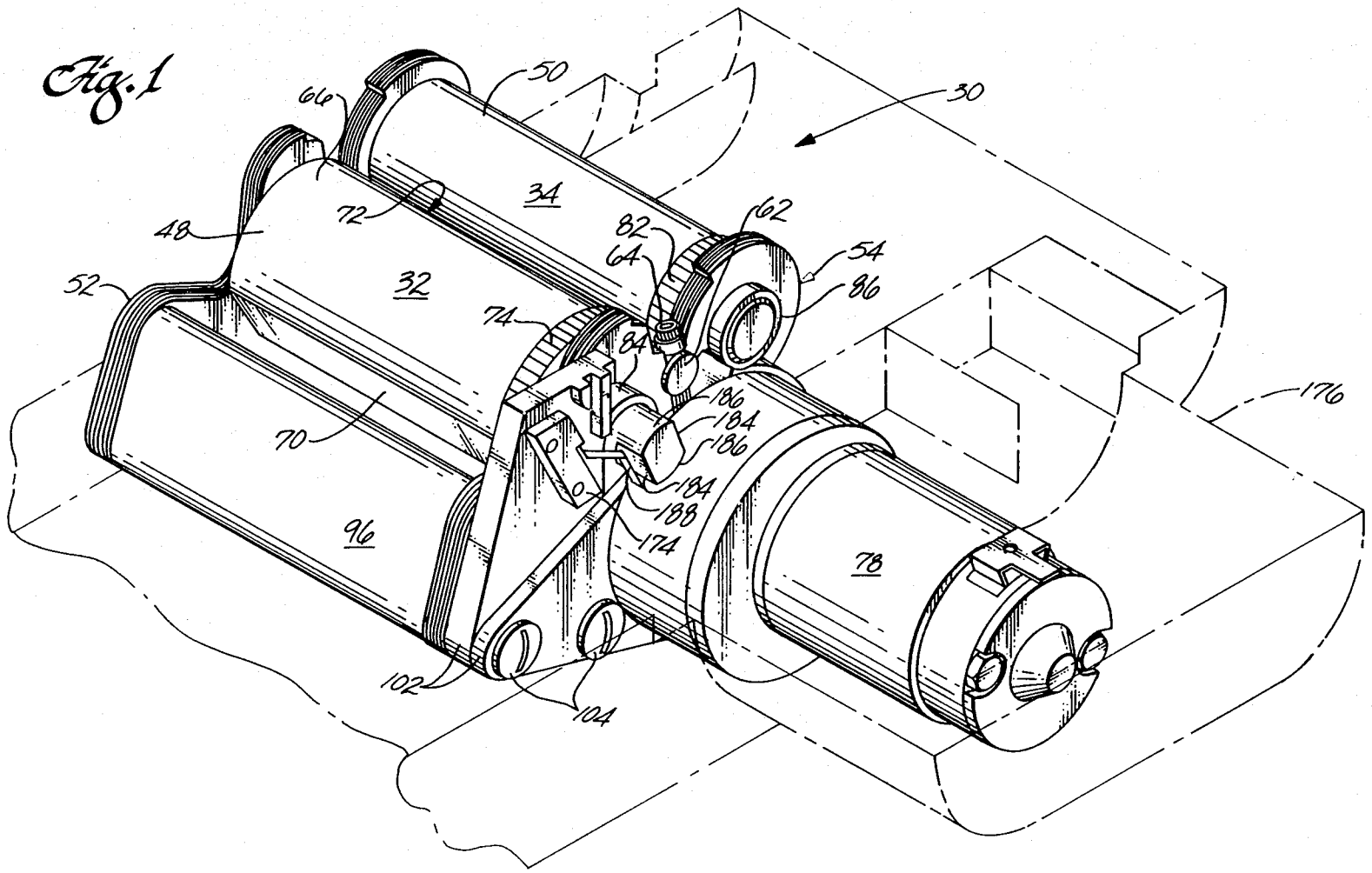
FIG. 1 is a schematic and perspective view of an apparatus for cutting indicia from tape and showing a pair of parallel spring tensioned pressure rollers supported by side plates and an electric motor for driving the rollers.
Figure 2:
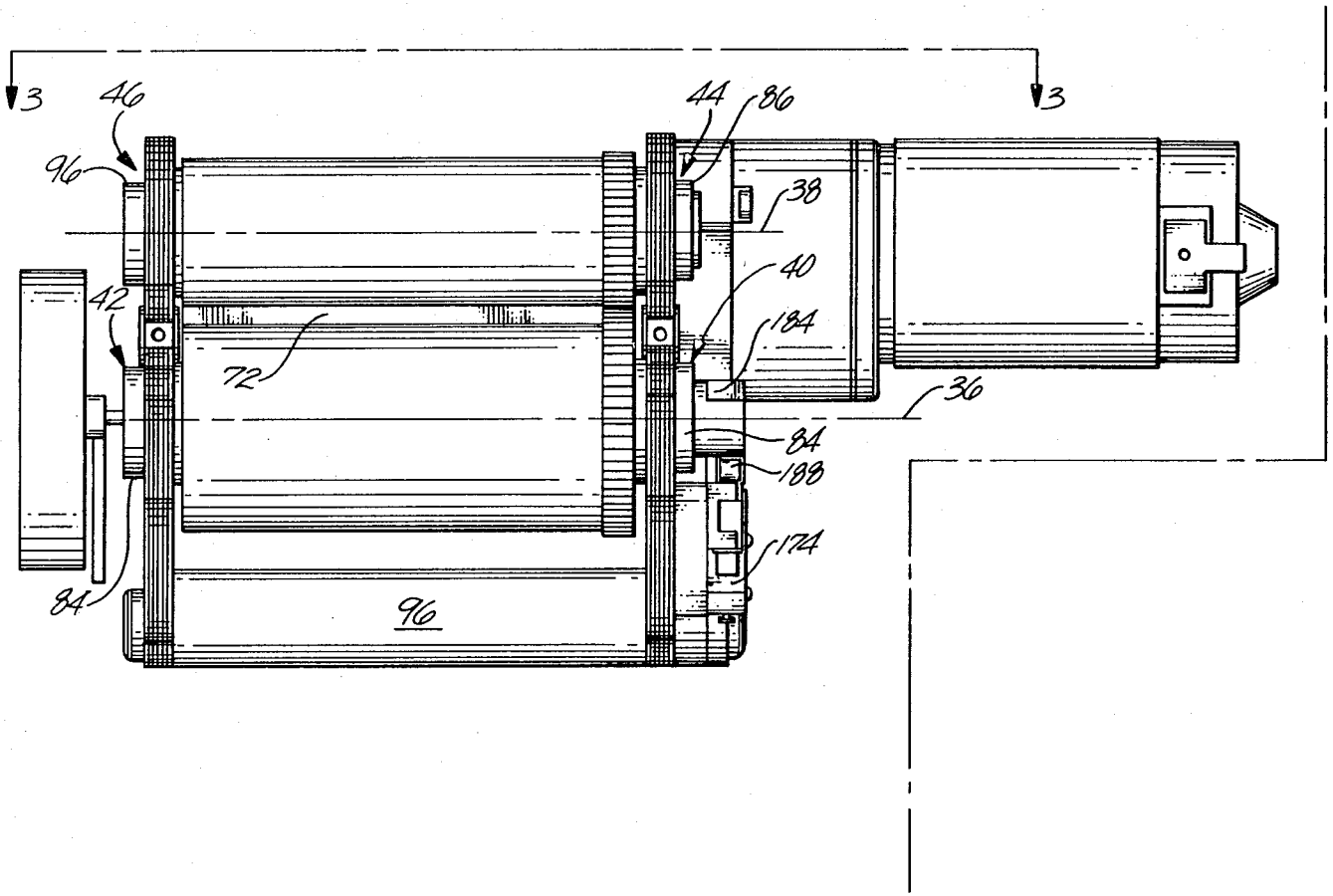
FIG. 2 is a schematic and top plan view of the apparatus of FIG. 1.
Figure 3:
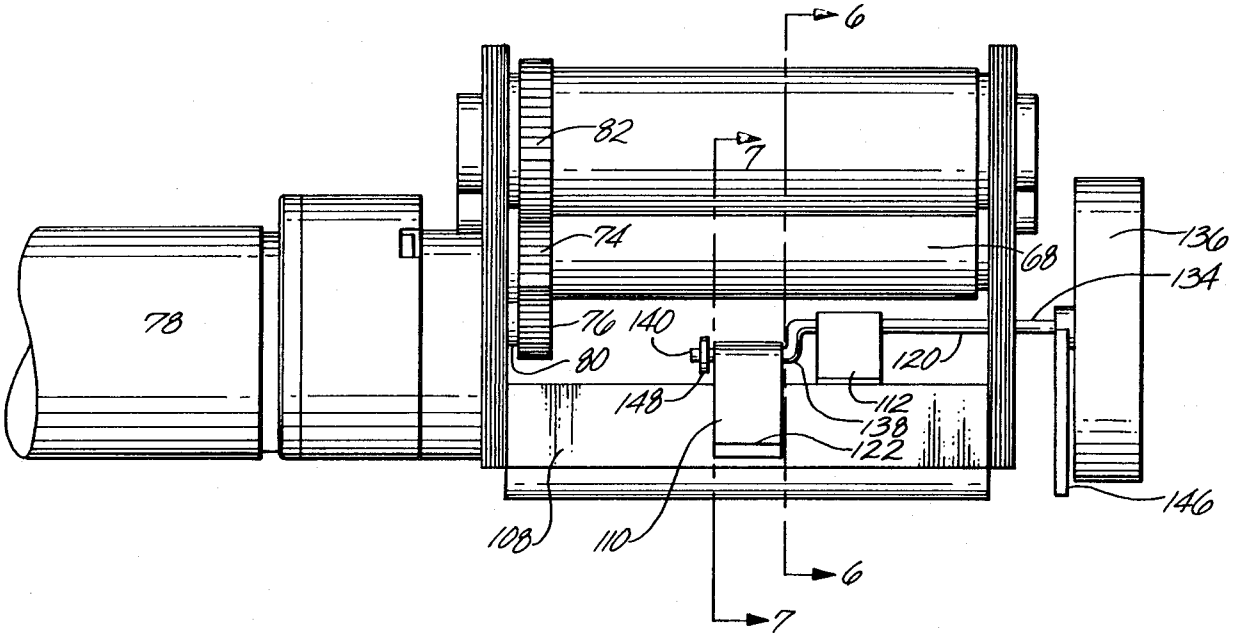
FIG. 3 is a schematic and rear elevation view of the apparatus of FIG. 1.
Figure 8:
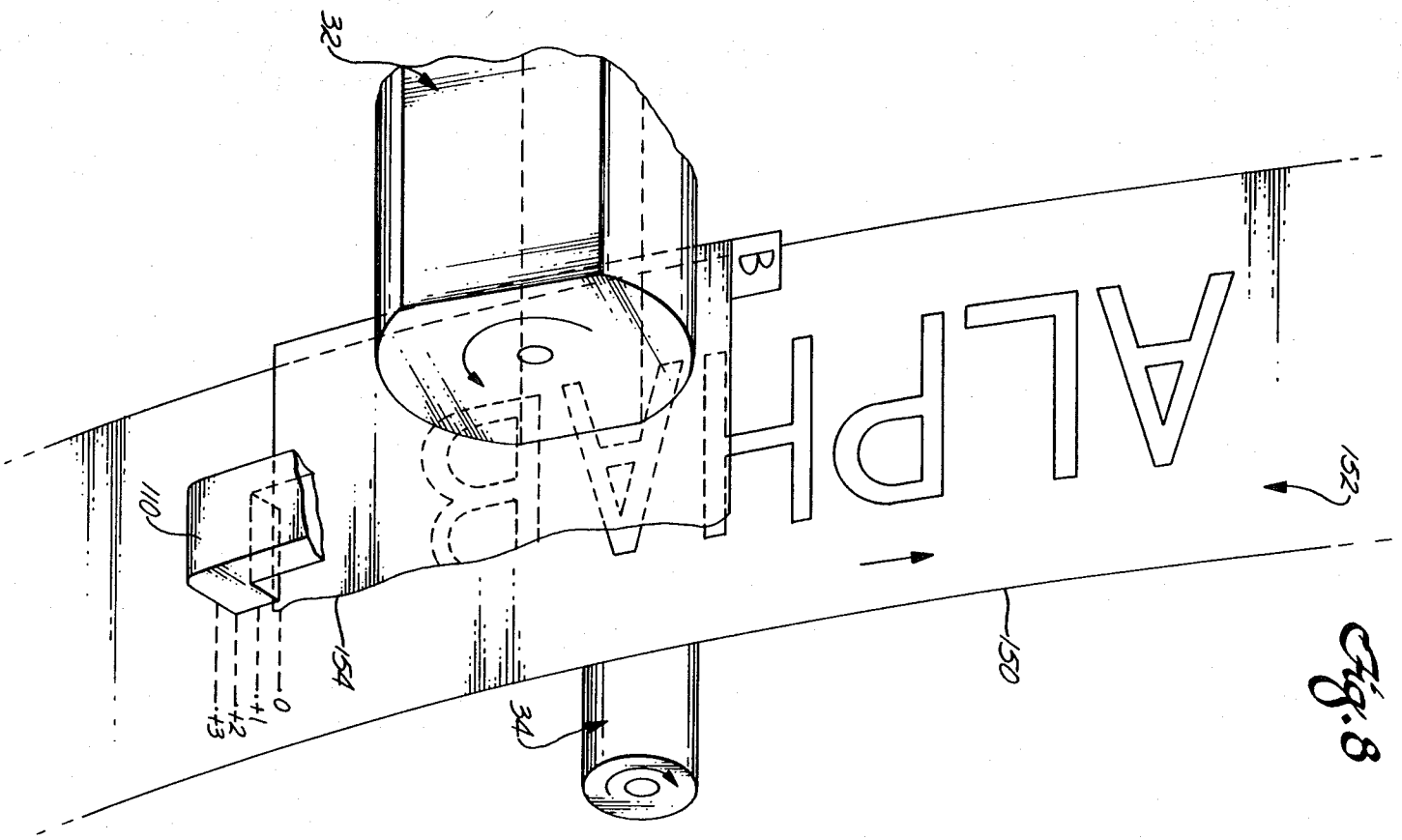
FIGS. 8, 8A, 9, 9A, 9B, 10 and 10A are schematics and partial cut-away views of the rollers of the apparatus of FIG. 1 showing the use of the die plate and tape for cutting indicia on the tape.
Figure 9:
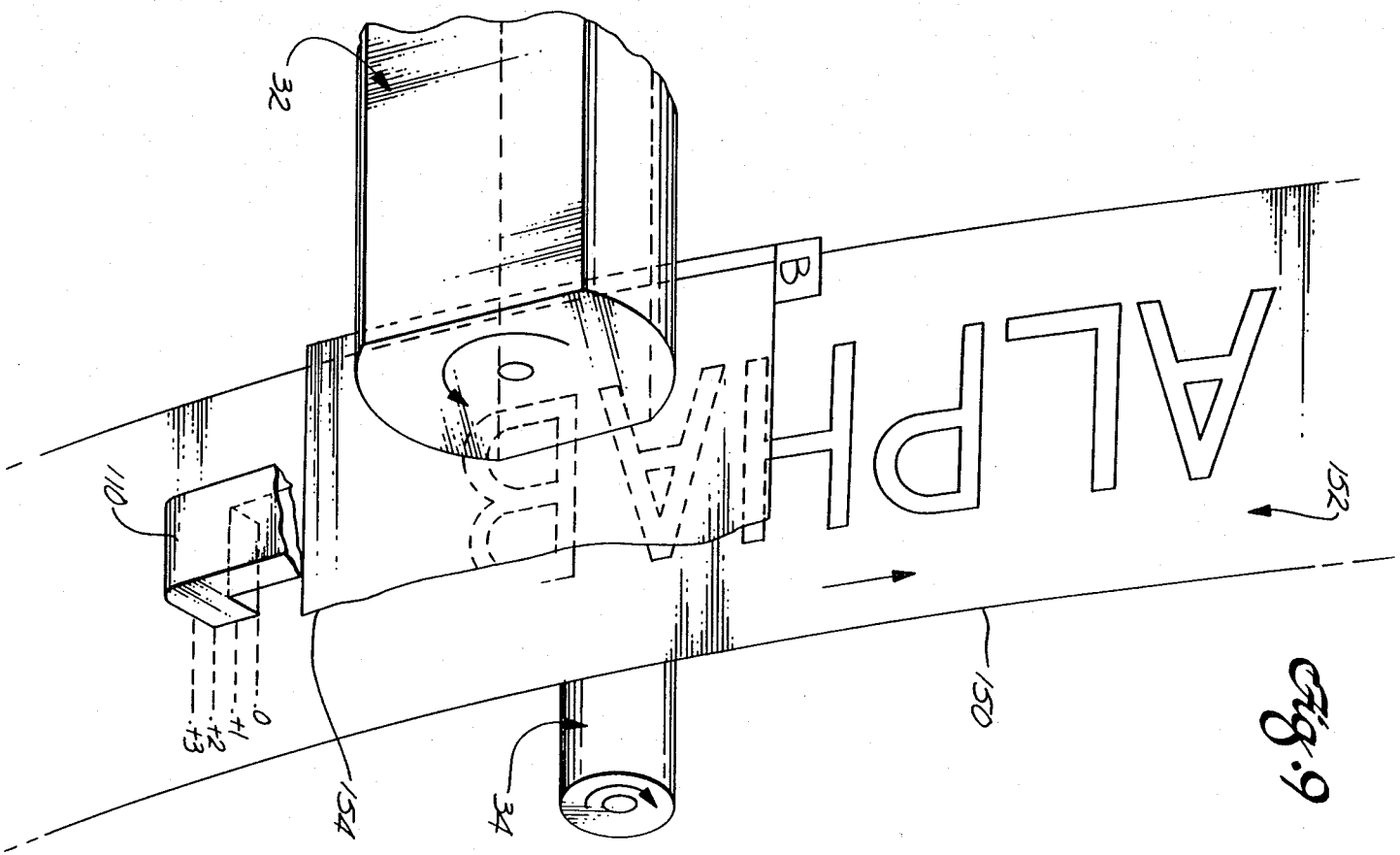
Figure 10:
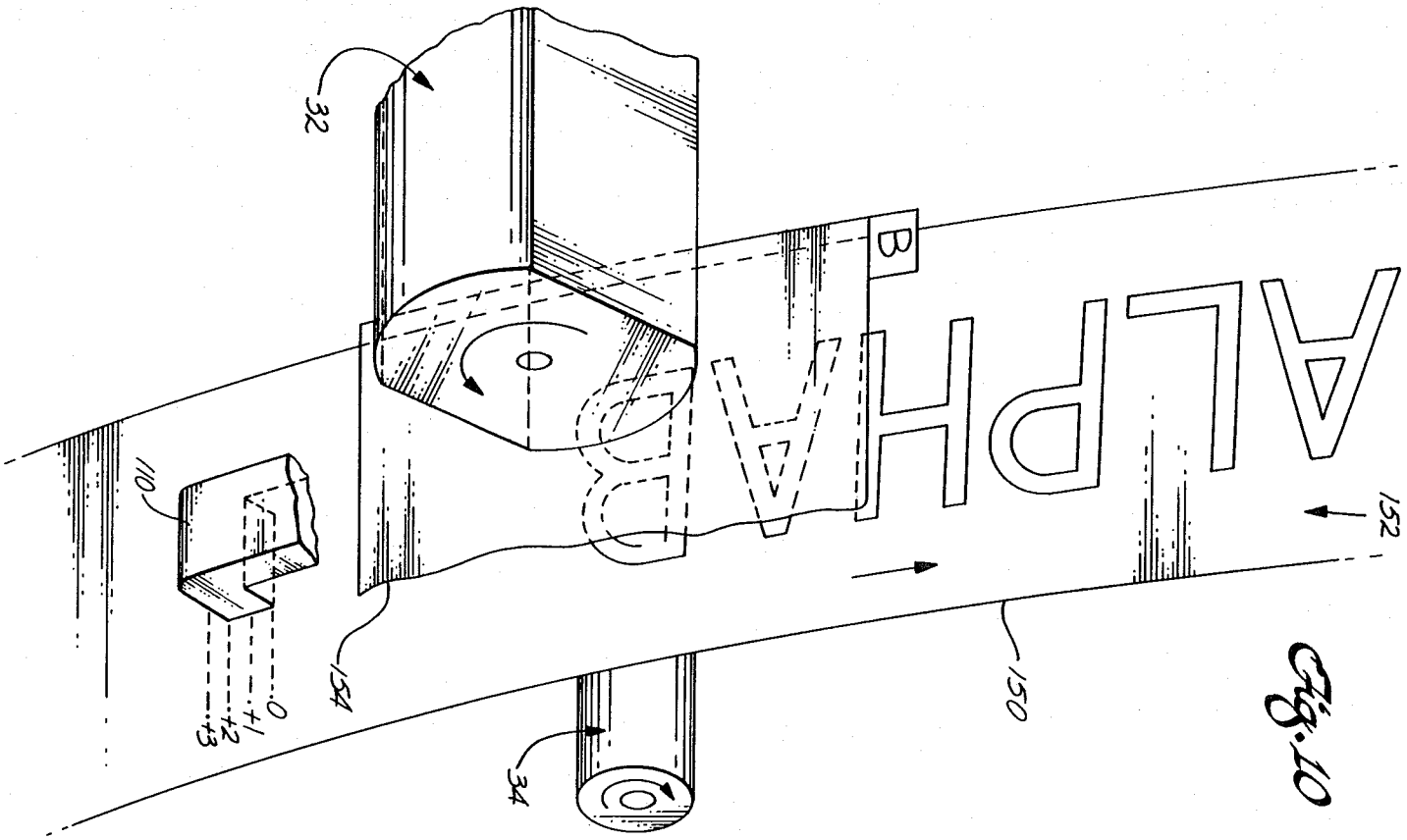

Considering FIGS. 1–3, a portable apparatus 30 for cutting interspaced, prealigned indicia from tape includes a pair of pressure rollers in the form of a large, flatted pressure roller 32 and a small pressure roller 34 for forming indicia on a strip of tape using a die plate (shown in FIGS. 8–10). The indicia may be any character such as a letter, number or design. Hereafter, it will be assumed that a letter is to be formed. The tape is preferably tape such as is shown in U.S. Pat. No. 3,558,425. The tape will be sometimes referred to as lettering tape though any type of indicia can be formed therein.

The large roller includes a large roller axis 36 about which the large roller rotates. The small roller includes a small roller axis 38 about which the small roller rotates. The large roller has a first end 40 and a second end 42 by which it is supported for rotation about the axis 36. The small roller has a first end 44 and a second end 46 by which the small roller is supported for rotation about its axis 38. The large roller further includes a large roller surface 48 and the small roller further includes a small roller surface 50, each for pressing the die plate and tape toward the other for forming a letter on the tape using the die plate, as discussed more fully below.

A left side plate 52 is provided for supporting the second ends 42 and 46, respectively, of the large and small rollers. A right side plate 54 is provided for supporting the first ends 40 and 44, respectively, of the large and small rollers. The pair of rollers are supported such that the rollers are oriented with the roller surfaces beside each other and with the axes extending parallel to each other so that the rollers may rotate about their respective axes for pressing the die plate into the tape as the die plate and tape are pulled between the rollers. The right side plate 54 includes curved spring ends, seen more clearly in FIG. 5, in the form of ends 58 and 60 for biasing the roller surfaces together with respect to each other. The left side plate 52 is preferably identical to the right side plate.

Each of the side plates further includes a plate adjuster 62 and an adjust screw 64 for separating the ends and for counteracting the biasing of the rollers.

The apparatus will now be considered in more detail with respect to FIGS. 1–7. The large flatted roller 32 includes a pair of oppositely facing arcuate surfaces 66 and 68, respectively, for applying pressure to the die plate and tape when the die plate and tape are placed between the large roller 32 and the small roller 34. One arcuate surface 66 is shown in FIG. 1 and the other arcuate surface is shown in FIG. 3. Only one arcuate surface applies pressure to an individual die plate during a given cycle. A cycle is taken to be one-half a rotation of the large roller, or 180°, thereby forming a single letter in the tape.

The large roller also includes a pair of oppositely facing flats 70 and 72, respectively, for providing a gap between the pressure rollers for inserting and removing die plates in between cycles. The function of the flats will be described more fully below.

The large flatted roller 32 includes a large roller gear 74 mounted coaxially to the roller and preferably positioned next to the right side plate 54. As shown in FIG. 3, the gear 74 meshes with a pinion gear 76 coupled to a motor 78 through a shaft 80. The motor 78 advances the large roller 32.

The small pressure roller 34 includes a small roller gear 82 mounted coaxially to the roller 34, preferably adjacent the right side plate 54. The mall roller gear 82 meshes with the large roller gear 74 so that the motor drives both the large and small rollers.

In the preferred embodiment, the diametrical distance between the first arcuate surface 66 and the second arcuate surface 68 of the flatted pressure roller is 1.475 inches. The perpendicular distance between the flats is preferably 1.375 inches. Additionally, the diameter of the small pressure roller 34 is 0.957 inches. These dimensions are chosen so that the diameter of the small pressure roller is slightly greater than one-half the diameter of the flatted roller. This, coupled with the selection of the gear ratio of gears 74 and 82 allows the two rollers to rotate at approximately the same angular velocity as seen by the surface of the tape adjacent the die plate. The larger diameter roller presents a lesser curvature surface to the die plate so that the die plate travels more in a straight line as it moves between the rollers. Ideally, it would be preferred to have a flat surface pressing against the die plate and moving it upward. This would minimize the rocking that appears to occur as the cutting line on the die plate first contacts the tape. It is believed that rocking of the die plate causes cutting of the lowermost layer of the tape. The fact that the ratio of the diameter is slightly different than 2:1 enhances the quality of the letter-forming process by minimizing any slipping of the die plate and the lettering tape relative to each other. Because slipping of the lettering tape and die plate is controlled to a greater extent than previously, the frictional engagement between the pressure roller and the tape is less important. Therefore, the rollers can be anodized aluminum rather than stainless steel.

The flatted pressure roller 32 and the small pressure roller 34 are rotatably supported at their ends by respective bushings 84 and 86. The flatted roller is supported by a bushing 84 at each end, as indicated in FIG. 2 and the small pressure roller 34 is supported at each end by respective bushings 86. Each pair of bushings supports the respective roller in the left and right side plates 52 and 54.

Figure 5:
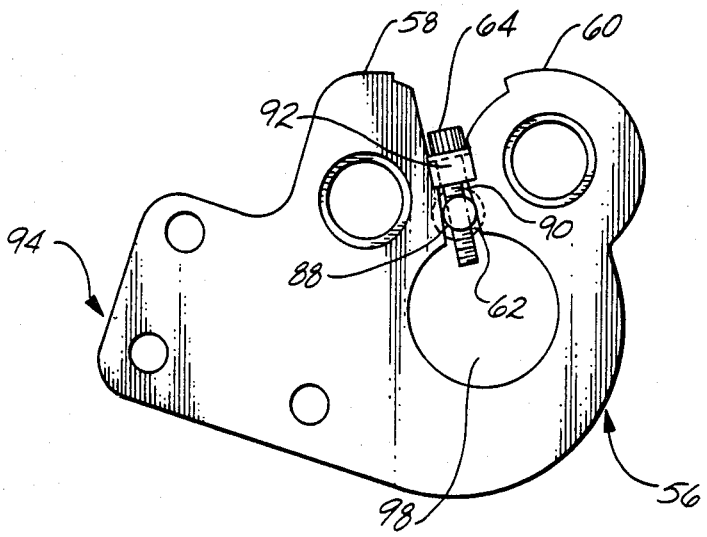
FIG. 5 is a schematic and side elevation view of a spring-tensioned supporting side plate for the apparatus of FIG. 3.
Figure 6:
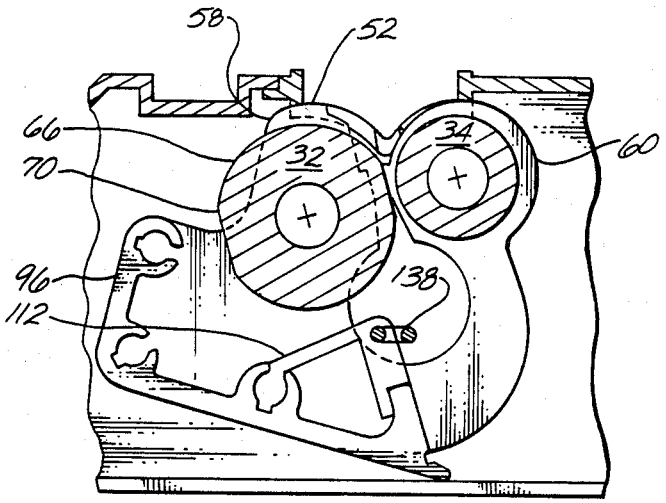
FIG. 6 is a schematic and partial side section of a portion of the apparatus of FIG. 3 taken along line 6—6 showing a side plate and rollers supported by the side plate.

As shown in FIG. 5, each side plate includes curved spring portions 56 and spring ends 58 and 60. The spring portions and ends serve to bias the rollers together with respect to each other. Therefore, any force, for example due to the passage of a die plate and tape between the rollers, would be opposed by the compressive forces on the ends of the rollers exerted by the spring ends. The rollers are maintained at a minimum separation by the plate adjuster 62, the position of which is adjustable by the adjuster screw 64. The interior facing edges 88 and 90 of the spring ends 58 and 60, respectively, converge upwardly away from the curved spring portions toward an adjuster screw saddle 92 (as viewed in FIG. 5).

Therefore, relative movement of the plate adjuster will force the spring ends together or apart as appropriate.

By forcing the spring ends apart from their free position, the side plates become preloaded to a certain extent because of the resilient or spring nature of the spring ends. The preloading by expansion is preferred over the tightening down of the rollers in the prior device. The counterforce developed in the spring ends is proportional to the distance the spring ends are moved apart. Preloading develops the counterforce prior to passing the die plate between the rollers so that the drive lugs and cutting lines on the die plate do not have to bear the brunt of the preloading step. It is believed that preloading through the plate adjuster also enhances the quality of the letter formed in the tape. Therefore, the drive lugs have less of a preload function than before. Preferably, all preloading of the side plates occurs before any letter cutting takes place.

The side plate also includes a mounting portion 94 for mounting the side plate on an appropriate support, for example, base 96, described more fully below. The side plate is positioned with the base 96 so that the lettering tape and die plate follow a path between the rollers which is approximately 15° away from the vertical at the point where the tape and die plate are between the rollers.

Each side plate is preferably made from stainless steel laminates approximately 0.025 inch thick. The stainless steel is preferably 301 stainless steel, ¾ hard. The number of individual lamina used for a particular side plate will depend upon the size of the lettering machine, the width of the tape and die plate. For example, six lamina made from the stainless steel described above would be used where the tape machine is intended for lettering 1¾ inch tape. Preferably, the six lamina are cemented or bonded by welding or otherwise to prevent buckling or warping of the individual lamina.

Use of such side plates allows greater tolerance in the dimensions of the remaining components. For example, the use of prestressed spring side plates allows for greater tolerances in the die plate dimensions, the roller dimensions, and the tape thickness. The number of lamina and type of steel is selected to provide the desired results in lettering the tape without slippage, wrinkling or overcutting of the tape. Preferably, the unstressed center-to-center distance between the bushing openings in the ends 58 and 60 is 1.252 inches. The angle of divergence of each of the edges 88 and 90 with respect to a diameter of opening 98 coaxial with the adjust screw 64 is approximately 10°. At the narrowest point, the distance between the edges 88 and 90 is approximately 0.14 inches.

Figure 4:
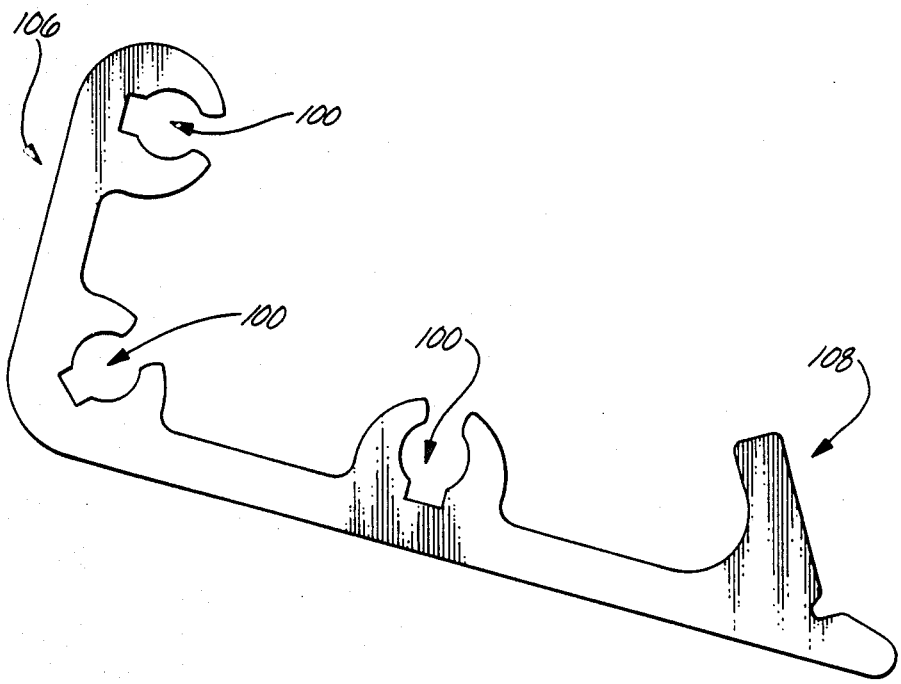
FIG. 4 is a schematic and side elevation view of a base for the apparatus of the present invention.

The base 96, more clearly shown in FIG. 4, separates and supports the left and right side plates 52 and 54, respectively. The base includes preferably three sockets 100 for accepting machine screws to mount the side plates to the base 96. Two of the three sockets are used to fasten the motor 78 and the motormount 102 to the right side of the base. Two motormount screws 104 are shown in FIG. 1. One socket is formed in a flange portion 106. At an end of the base opposite the flange portion, a slide portion 108 extends at an angle of approximately 60° from the rest of the base to which it is attached. The base will be mounted in the apparatus at an angle of 15° from the horizontal so that the slide portion is 15° from the vertical. The slide portion is also shown in FIG. 3. The slide portion supports a kerning adjuster 110 and a kerning shaft support 112, to be described more fully below. In the preferred embodiment, the base supports the rollers and motor such that the opening between the rollers extends approximately 15° from a vertical line, similar to the arrangement depicted in FIG. 6.

Figure 7:
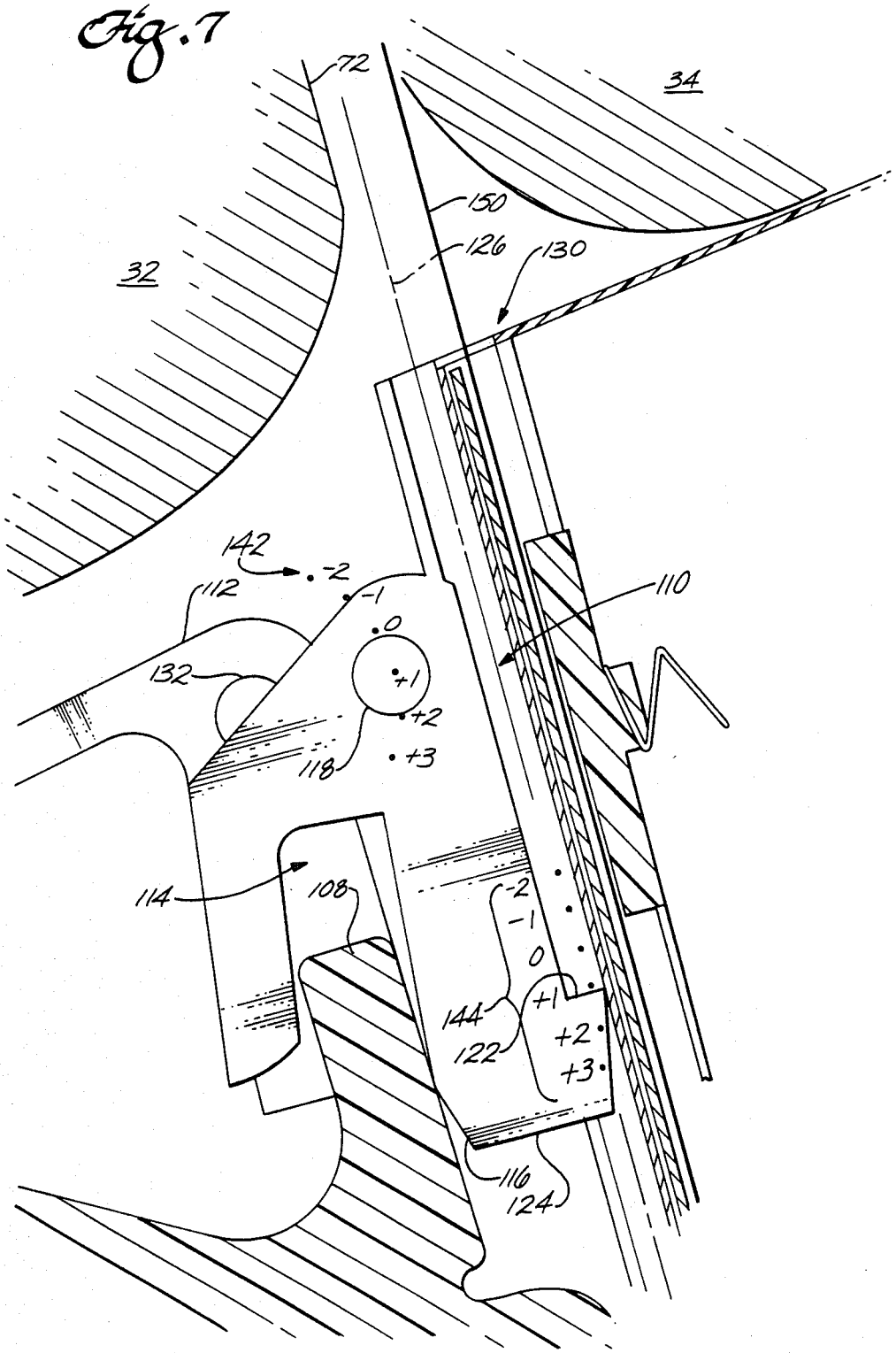
FIG. 7 is a schematic and partial side section of the apparatus of FIG. 3 taken along line 7—7 showing a kerning adjuster slidable over a portion of the base of the apparatus.

FIG. 7 shows the kerning adjuster 110 including a groove 114 for fitting over and sliding on the slide portion 108 of the base. A bevel 116 formed along the bottom of the groove allows tolerance movement of the adjuster over the slide portion 108. This is due to the fact that the kerning adjuster movement is not entirely linear. A kerning shaft hole 118 extends through a top portion of the kerning adjuster 110 in a direction generally parallel to the axes of the rollers for accepting a kerning shaft 120 (FIG. 3) for moving the kerning adjuster higher or lower with respect on the slide portion 108 with respect to the rollers. A kerning ledge 122 extends outwardly from the groove 114, and on the opposite side of the adjuster from the groove, for supporting and positioning the die plate with respect to the rollers and the lettering tape. The position of the die plate with respect to the rollers and the lettering tape is adjusted by raising and lowering the kerning adjuster for each particular letter to be formed in the lettering tape to adjust the prespace of the letter. After formation of each letter, the kerning adjuster may then be changed to change the position of the next die plate prior to formation of the next letter.

The ledge forms a right angle with the back 124 of the kerning adjuster for supporting the die plate at a preferred angle of approximately 15° with respect to the vertical. An axis 126 indicates a line at approximately 15° from the vertical. When the flatted roller is positioned as indicated in FIG. 7, the axis would extend between the flatted roller and the small pressure roller. Additionally, the ledge 122 on the kerning adjuster 110 extends outwardly from the back sufficiently so that the axis intersects the ledge, i.e., so that the die plate rests on the ledge when between the rollers.

A die plate support 128 is provided in addition to the ledge for supporting a die plate between the flatted pressure roller and the small pressure roller. A tape supply 130 is also provided for supporting and supplying lettering tape to a point between the rollers and adjacent the die plate supported on ledge 122. The tape supply includes a tape pullback for retracting the lettering tape, preferably an amount of 0.225 inches, for starting formation of the next letter closer to the next preceding letter than was previously possible. This effectively allows for decreasing the prespace of a letter to such an extent that there is a negative prespace, i.e., the next succeeding letter extends into the post space of the preceding letter. A more detailed description of the die plate support and the tape supply is provided below and in the copending application Ser. No. 06/895, filed Aug. 12, 1986.

As shown in FIG. 7, the kerning shaft support 112 includes a kerning shaft hole 132 for accepting and supporting the kerning shaft 120. As best seen in FIG. 3, the kerning shaft includes a first straight portion 134 coupled at one end to a kerning knob 136, which kerning knob allows an operator to adjust the spacing between letters to be created on the lettering tape. The kerning shaft transfers any rotational movement caused by the operator turning the kerning knob through an angled portion 138 of the kerning shaft to a second straight portion 140 extending through the kerning shaft hole 118. Therefore, turning of the kerning knob 136 causes sliding motion of the kerning adjuster 110 over the slide portion 108 of the base. The kerning adjuster moves along the slide portion and follows the movement of the second straight portion of the kerning shaft so that the ledge 122 and therefore the die plate supported thereon substantially follows the axis 126. The kerning shaft support 11 is stationary with respect to the base and the kerning shaft hole 132 therefore acts as a bearing surface and pivot for the kerning shaft 120.

As the kerning shaft is rotated in the hole 132, the second straight portion 140 follows an arc defined by the dots 142. Though the second straight portion of the kerning shaft moves along an arc, the die plate will nonetheless be moved substantially linearly due to the slide portion of the base and the groove 114 of the kerning adjuster. In effect, the rotational motion of the kerning knob is translated into linear motion of the die plate in order to vary the spacing of letters created on the lettering tape. The rotation of the kerning knob positions the second straight portion 140 at the locations represented by dots 142. When the second straight portion is positioned at any one of the dots 142, the ledge 122 is simultaneously positioned at a respective dot in the group of dots 144. The kerning knob may also be supported by a kerning knob support 146 FIG. 3. The kerning adjuster 110 is held on the shaft by a clip 148.

FIGS. 8, 8A, 9, 9A, 9B, 10, and 10A show schematically the process of lettering tape. The elements of these figures common to the elements in the previously described drawings are identically numbered. The FIGURES further show lettering tape 150 in which letters 152 are formed using the pressure rollers and various die plates. A die plate 154 containing a particular letter, for example the letter "B", is placed between the lettering tape and the flatted roller for forming the letter in the tape during operation of the lettering machine. The tape already has formed in it "ALPHA". The tape has been pulled through the gap between the rollers with formation of each letter. The last "A" of "ALPHA" has just been formed and it will be assumed that no tape pullback occurs. The numbers 0 through +3 correspond to those numbers shown in FIG. 7. The process depicted in FIGS. 8, 8A, 9, 9A, 9B, 10 and 10A will be discussed more fully below.

Figure 12:
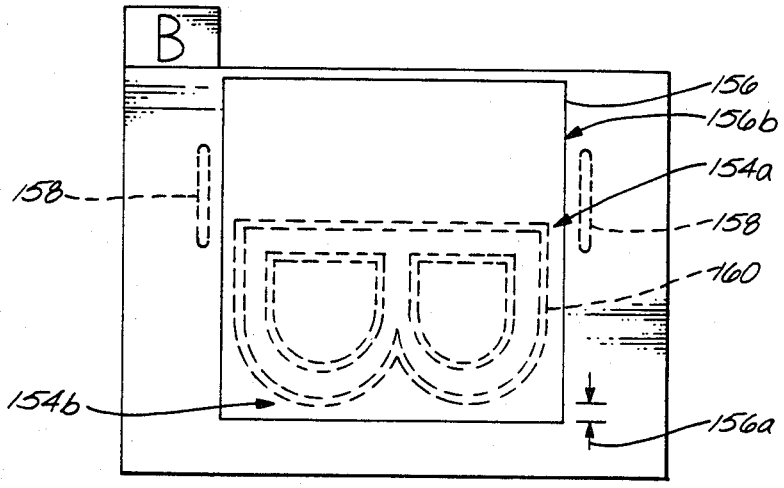
FIG. 12 is a front elevation view of a die plate used with the apparatus of FIG. 1.
Figure 13:
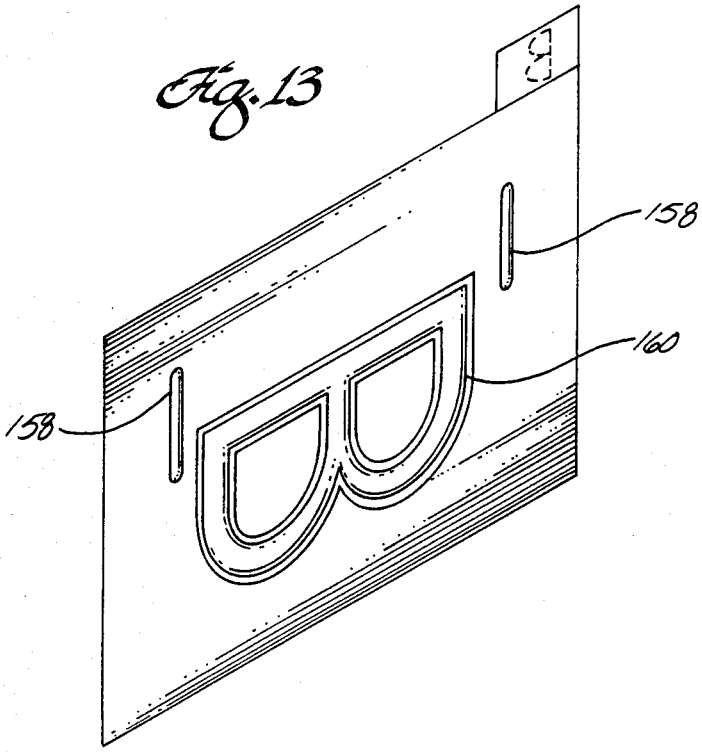
FIG. 13 is a perspective view of the rear side of the die plate of FIG. 12.

A die plate is shown in more detail in FIGS. 12 and 13. FIGS. 12 and 13 show a front and back view, respectively, of the die plate. Each letter is preferably formed on its die plate so that the leading edge **154*a* of the letter is always a given distance from the bottom of the die plate. The position of the trailing edge 154*b* will depend on the width of the letter. In the preferred embodiment, a label 156 is placed on the front of the die plate 154 for facilitating take-up of the die plate and lettering tape as the flatted pressure roller and small pressure roller advance. The thickness of the label is chosen as a function of the separation distance between the two rollers during operation, the lettering tape thickness and the thickness of the die plate 154** over which the label is placed. The separation between the rollers during operation is taken to be the distance between the roller surfaces when one of the arcuate surfaces of the flatted roller is immediately opposite the small pressure roller. Since the lettering tape is usually of a known thickness, within certain tolerances, and the die plate is of a known thickness within certain tolerances, the label is also designed with a certain thickness so that the pressure from both sides due to the two pressure rollers creates a frictional force for pulling the die plate and tape together between the rollers. The label adds a predetermined thickness to the material between the rollers to allow the pulling. The thickness of the label is such that the die plate and tape advance only when the label is in the separation between the rollers.

The vertical height, as seen in FIG. 12, of the label 156 is selected according to the size and position of the particular letter formed in the die plate. For example, the label used on a die plate for a "V" may be larger than the label for a "W" of the same letter type. More specifically, the height of the label depends on the distance from the leading edge to the trailing edge of the letter. However, this is fixed for each letter. The post space **156*a* for all letters is also fixed and is preferably 0.060 inch. The post space is the distance from the trailing edge 154*b* of the letter to the bottom or end of the label. The end of a label is the point where the pressure rollers no longer grip the die plates and tape sufficiently to advance them. The top of the label extends a predetermined distance above the leading edge of the letter and also extends at least as high as the drive lugs. The top of the label is used, along with the position of the kerning adjuster, to provide the desired prespace 156*b***. The amount of prespace produced on the tape will vary according to the position of the die plate relative to the rollers.

Figure 9A:
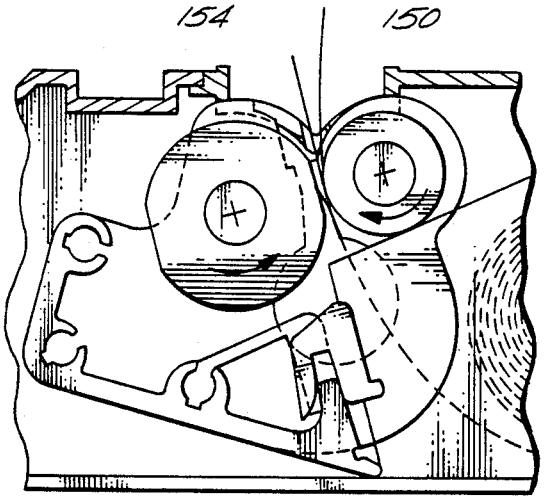
Figure 10A:
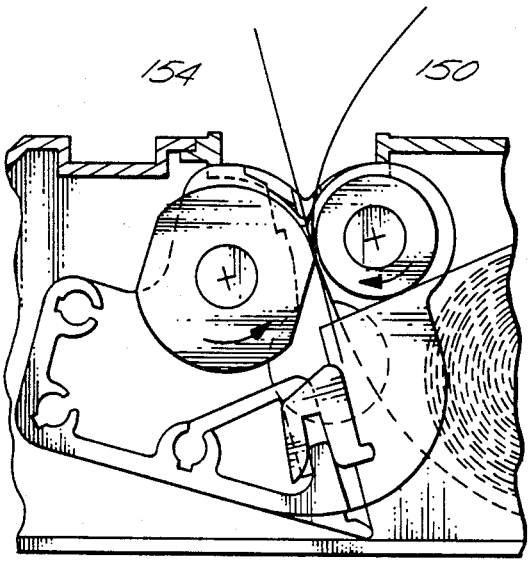
Figure 9B:
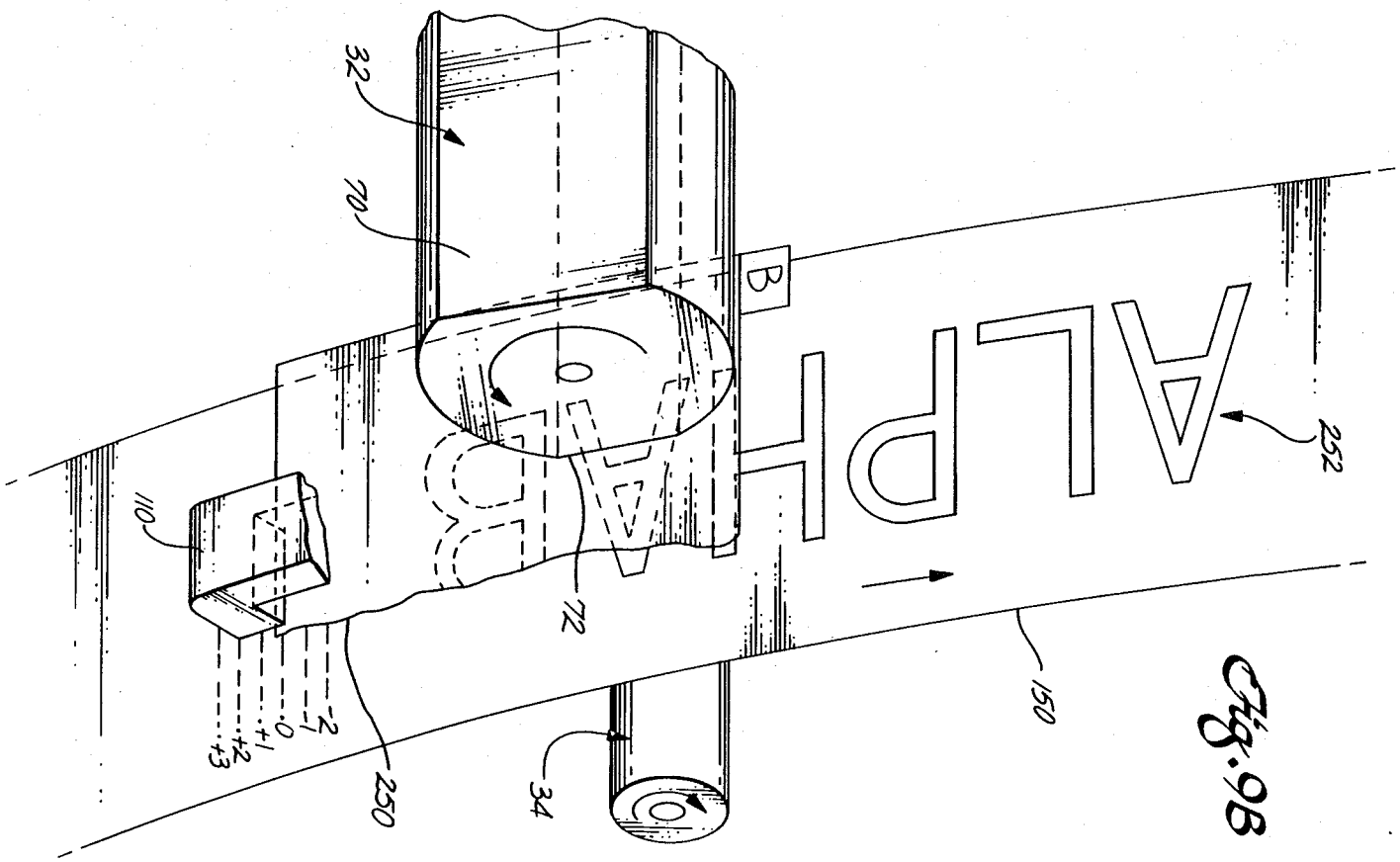

Considering FIG. 9 and the relative position of the die plate and the kerning adjuster, the standard position of the kerning adjuster identified by the numeral "0" provides for standard spacing of adjacent letters. In other words, the kerning adjuster is designed relative to the pressure rollers so that the die plate produces the proper interletter spacing after the letter is formed by the die plate. The interletter spacing is defined partly by the prespace on the die plate which in turn is determined by the distance between the point at which the surfaces of the pressure rollers come together to pull up the die plate and the point at which the letter is first begun to be formed, i.e. the leading edge. The interletter spacing is also partly defined by the total width of the letter from the leading edge of the letter to the trailing edge of the letter. Finally, the interletter spacing is partly defined by the post spacing or the distance between the trailing edge of the letter and the point at which the surfaces of the pressure rollers no longer grip the die plate sufficiently to continue pulling the die plate and lettering tape. For any given letter on a die plate, the width of the letter is a constant. Additionally, the post spacing is always constant. A minimum amount of post spacing is preferred to ensure that the trailing edge of the letter is fully formed before the pressure rollers release the die plate and the tape. Therefore, the interletter spacing can be varied by changing the prespacing, i.e. by changing the starting point at which the pressure rollers pick up the die plate and tape. As seen in FIG. 9B, the prespacing can be increased by lowering the kerning adjuster so that the pressure rollers rotate further and the die plate and tape travel further between the pressure rollers before the letter is formed on the tape. This increases the interletter spacing. The prespacing can be decreased by raising the kerning adjuster with respect to the rollers so that the pressure rollers rotate less and the die plate and tape travel less between the pressure rollers before the letter is formed on the tape.

The width of the label is selected to extend a sufficient distance to allow the pressure rollers to frictionally grip the die plate and lettering tape for pulling them together between the rollers. In the preferred embodiment, the label extends substantially to each of a pair of drive lugs 158 formed in the die plate for allowing the pressure rollers to frictionally grip the die plate and lettering tape together during the operation of the rollers. The drive lugs shown in FIG. 12 are dashed to indicate that the lugs are formed in the die plate and extend into the paper of FIG. 12. FIG. 13 shows the drive lugs raised from the surface of the die plate. The drive lugs generally serve the same function as the label 156 and make contact with the tape. The rollers grip the die plate and tape through the drive lugs to move the die plate and tape upward during operation of the rollers. A letter 160 is formed in a die plate during its manufacture by pressing the die plate so that the letter is raised from the surface of the die plate as indicated in FIG. 13. The raised portion forming the letter contacts the lettering tape and forms the letter therein, as described in the prior patents. The height of the letter from the surface of the die plate is determined according to the height needed for the rollers to press and grip the die plate and lettering tape for pulling the die plate and tape between the rollers while still forming the letter as desired. The raised portion defining the letter assists in gripping the lettering tape between the rollers while forming the letter at the same time. The die plate is preferably formed from a material such as a metal sufficiently strong to maintain its shape during the letter forming process.

Figure 14:
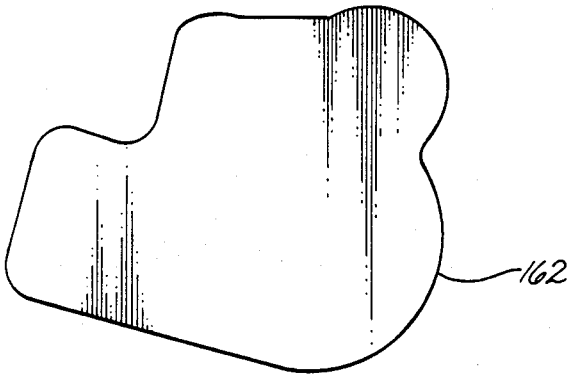
FIG. 14 is a schematic and top plan view of a die punch used in forming the side plates for the apparatus of FIG. 1.
Figure 15:
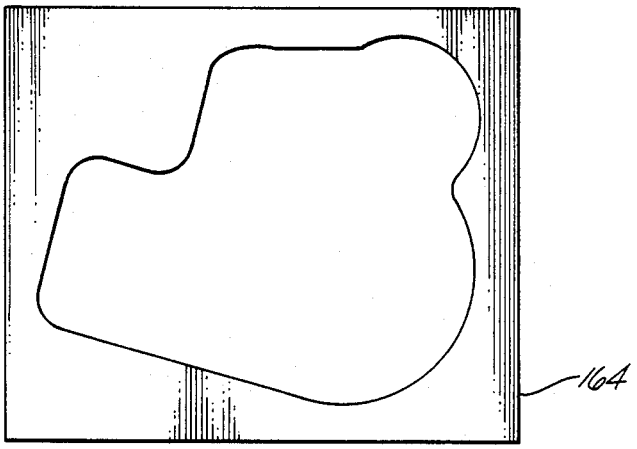
FIG. 15 is a schematic and top plan view of a die punch receiver used in forming the side plates.
Figure 16:
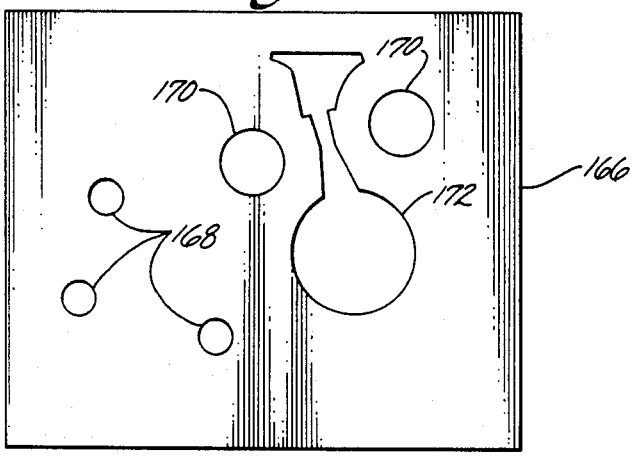
FIG. 16 is a schematic and top plan view of a die punch receiver used in producing a side plate for the apparatus.

FIGS. 14–16 show dies for forming the side plates from a stainless steel sheet. FIG. 14 schematically shows a die punch 162 having an outline substantially conforming to the outline of the side plate shown in FIG. 5. This die punch is used in conjunction with a mating die 164 shown in FIG. 15 for obtaining a rough die plate having an outline conforming to the die punch 162. The details of the side plate shown in FIG. 5 are formed using a die 166 similar to that shown in FIG. 16. Circular die punches may be used to form mounting holes 168, for example for the motormount screws 104. Circular die punches may also be used to form the openings 170 used to accommodate the bushings 84 and 86 described above. An additional die punch may be used then to form the opening 172 for defining the spring ends 58 and 60. The resulting side plate then has the form substantially as shown in FIG. 5, absent the bushings and adjust screw. As would be obvious to one skilled in the art, however, the side plates may be formed by chemical etching, EDM process or machining as well as blanking and stamping.

Figure 17:
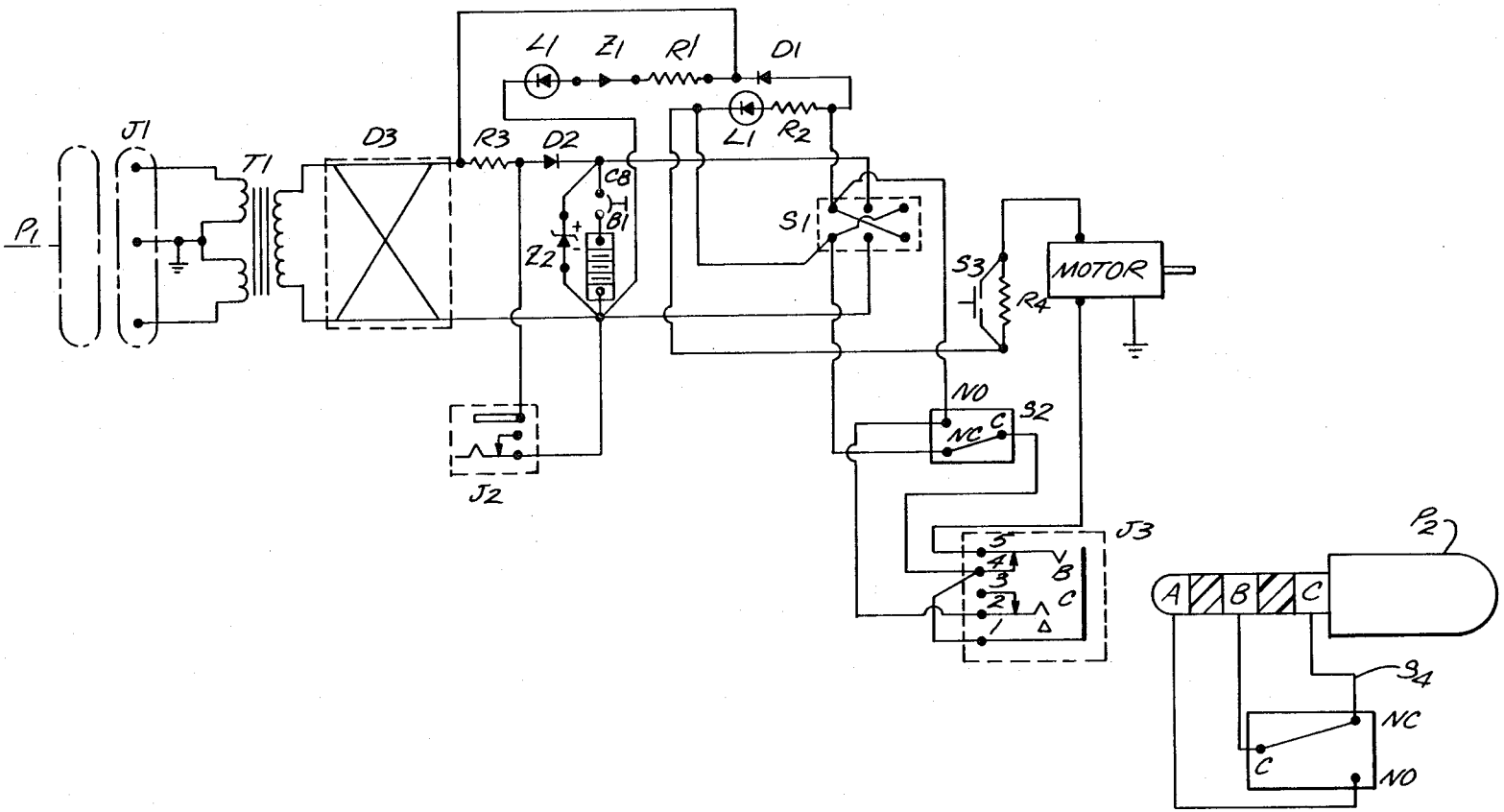
FIG. 17 is a schematic and block diagram of an electrical circuit for controlling the apparatus of FIG. 1.

FIG. 17 shows a schematic of an electronic diagram for wiring the lettering machine of the present embodiment. Pl indicates a three-conductor power cord assembly for supplying 110-volt alternating current to the lettering machine. A transformer T1 takes the 110-volt A.C. from its primary and converts it to 12 volts and 300 milliamps on the secondary. A rectifier D3 is placed across the secondary of the transformer to provide direct current through a diode D2 and a resistor R3 to a battery B1 placed in parallel with the rectifier and secondary of the transformer T1. The Zener diode will cause the LED L1 to go out if the battery level goes below 4.7 volts. The LED L1 emits light as a function of the charge on the battery. However, the LED L1 is lit at any time external power is applied to the circuit.

The secondary includes in parallel a resistor R1, a Zener diode Z1, and a light-emitting diode for indicating charging of a battery B1. A 12-volt input jack J2 is preferably placed across the battery B1 with one lead between the diode D2 and the resistor R3 to provide direct current from an external source such as a car battery to the circuit. A Zener diode Z2 is placed across the battery B1 to limit the charge voltage for the battery from the AC or DC supply. A circuit breaker CB limits the current applied to the battery. A 12 volt On/Off power switch S1 with momentary reverse is also placed across the battery and secondary of the transformer for operating the lettering apparatus. One side of the switch is coupled through a resistor R2 and a second light-emitting diode for indicating power "on" to the other side of the switch 51. A diode D1 isolates switch S1 from the rectifier and from the LED/Zener Z1 circuit. As viewed in FIG. 17, the "On" position is to the left of switch S1. The momentary reverse is located on the right side of switch S1 and crosses the terminals of the power "On" position so that current of the reverse polarity is provided to the motor 78. The momentary reverse is used to reverse the rollers to clear the apparatus.

The output from the "On" position, and therefore the reverse polarity output from the momentary reverse position, is provided to the inputs of a motor actuator stop switch S2. Switch S2 corresponds to limit switch 174 of FIG. 1. The positive lead from switch S1 is coupled to the normally open terminal of switch S2. The negative lead is coupled to the normally closed lead of S2. A second lead from the normally open terminal is coupled to a foot switch jack J3 and a lead from the common (C) terminal is also coupled to the foot switch jack J3 and through the foot switch jack to one side of the DC motor. The other side of the motor is coupled through a parallel connection of a resistor R4 and an interlock switch S3 to the negative side of power switch S1. The interlock switch is keyed to the cover of the machine so that if the cover is opened, current through the motor will flow through the resistor R4, significantly decreasing the rotational speed of the motor. This allows cleaning of the rollers and is a safety device.

A foot switch S4 is coupled to a foot plug P2 for connection to the foot jack J3 and complements actuator switch S2. The circuit configuration coupled to the motor is significant in that, with or without the foot switch, the motor can stop the rotation of the rollers instantaneously when either of the actuator switches S2 or S4 moves from the normally open to the normally closed positions. When the switches reach the normally closed positions, the motor is grounded and stops immediately. Therefore, proper positioning of the flatted pressure roller can be achieved after each cycle. Though an AC motor can be used in the apparatus, the ground braking arrangement would not work for an AC motor.

Figure 18:
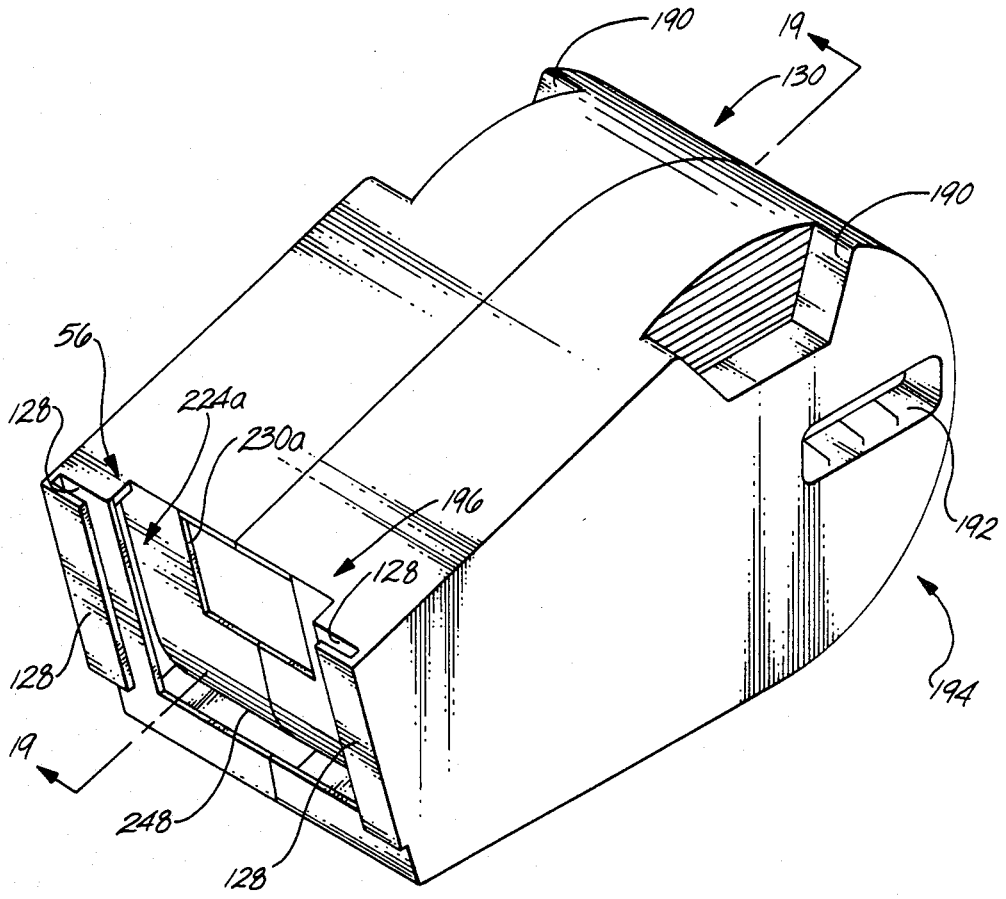
FIG. 18 is a perspective view of a tape supporting and supplying cartridge.

FIG. 18 shows the tape supply 130 in the form of a dispensing cartridge. Identical elements as those of FIG. 7 are identically numbered Additionally, FIG. 18 shows grip pockets 190 and a tape length indicator 192 at a tape end 194 of the cartridge opposite the guide end 196.

Figure 19:
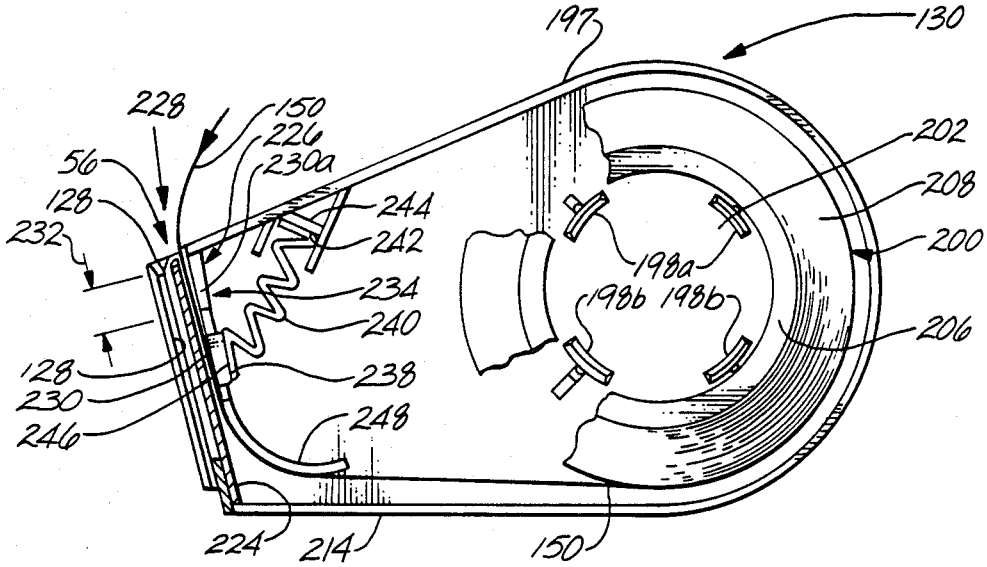
FIGS. 19 and 20 are side sections of the cartridge of FIG. 18.
Figure 20:
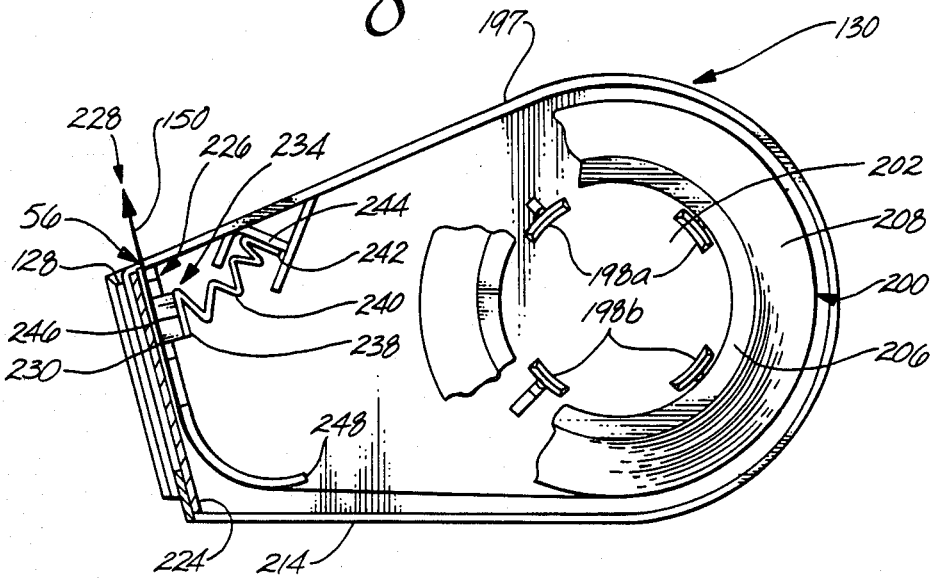

A further embodiment of the invention is shown in FIGS. 19 and 20. The cartridge includes a cartridge frame 197 for supporting the tape and for guiding the tape. Preferably, the frame substantially encloses the tape and is made from a durable plastic such as high impact styrene. The frame could also be a skeleton frame having a minimum of structure so that the tape is exposed. The term "cartridge" as used herein shall be taken to include any means for dispensing tape with any one or more of the characteristics described herein, including tape pull back, friction means to inhibit unraveling of the tape or friction means to provide sufficient tension in the tape for suitable letter-forming of the desired quality.

Figure 19A:
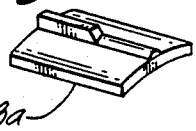
FIGS. 19A and 19B are perspective views of guide stands in the cartridge of FIGS. 19 and 20.
Figure 19B:
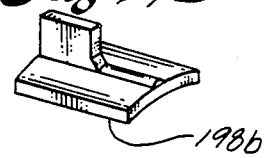

Four roll guide stands 198 are fixed to the frame for supporting a roll 200 of tape. The guide stands are preferably made of the same material as the frame. The guide stands may be bonded to the inside surface of one side 202 of the frame and extend inwardly toward a central plane defined by the junction 204 of two halves of the cartridge shown in FIG. 18. The guide stands, shown in FIGS. 19, 19A, and 19B, are designed so that the guide stands frictionally engage the core of the roll of lettering tape for producing a drag force. The drag force acts against a force on the end of the tape, pulling the tape from the cartridge. The frictional engagement, along with the tape bias described more fully below, requires a minimum force, for example, 3 pounds, necessary to withdraw the tape from the cartridge. In one embodiment, each of the guide stands includes an arcuate portion conforming to the curvature of the core of the lettering tape and the rounded ridge sending along the top center of the arcuate portion from a chamfered end of the arcuate portion to a flanged portion. The flanged portion extends higher from the top center of the arcuate portion and includes a slanted front face at an angle of approximately 45° with respect to the rounded ridge against which the edge of the core is placed. As shown in FIG. 19B, the flanged portion on the lower two guide stands **198*b* is higher than the corresponding flanged portion on the upper two guide stands 198*a***. The flanged portions on the lower two guide stands also serve to position and center the lettering tape as the cartridge is being assembled. Other arrangements can be made for the guide stands for frictionally engaging the core and lettering tape.

The guide stands in a further embodiment not shown in the Figures conform to the circular inside surface of the roll of tape. The guide stands include an end facing outwardly toward the middle of the tape roll which is beveled to provide a surface diverging away from the inside surface of the tape roll. The beveled surface facilitates mounting of the roll on the four guide stands.

It should be understood that four roll guide stands are also fixed to the second side of the cartridge opposite the first side 202 for supporting the roll of tape. The roll of tape includes a cardboard core 206 and multiple layers 208 of tape. The tape may be tape such as that described in U.S. Pat. No. 3,558,425. The core is placed about the four guide stands on each side of the frame so that the guide stands contact the interior surface of the cardboard core. The guide stands are formed so that the frictional engagement of the guide stands with the cardboard core prevent rotation of the roll with respect to the frame absent a significant pulling force on the end of the tape 54. In the preferred embodiment, three pounds of force is adequate to pull the tape from the cartridge, thereby overcoming the stationary functional force of the guide stands and of the pad, described below. The guide stands also contribute to maintaining the proper tension in the tape while letters are being formed. Proper tape tension enhances precise cutting. Therefore, the apparatus may include frictional engagement means, either integral with the apparatus or detachable, to limit tape unraveling and to contribute to tension in the tape for improved letter forming.

Figure 21:
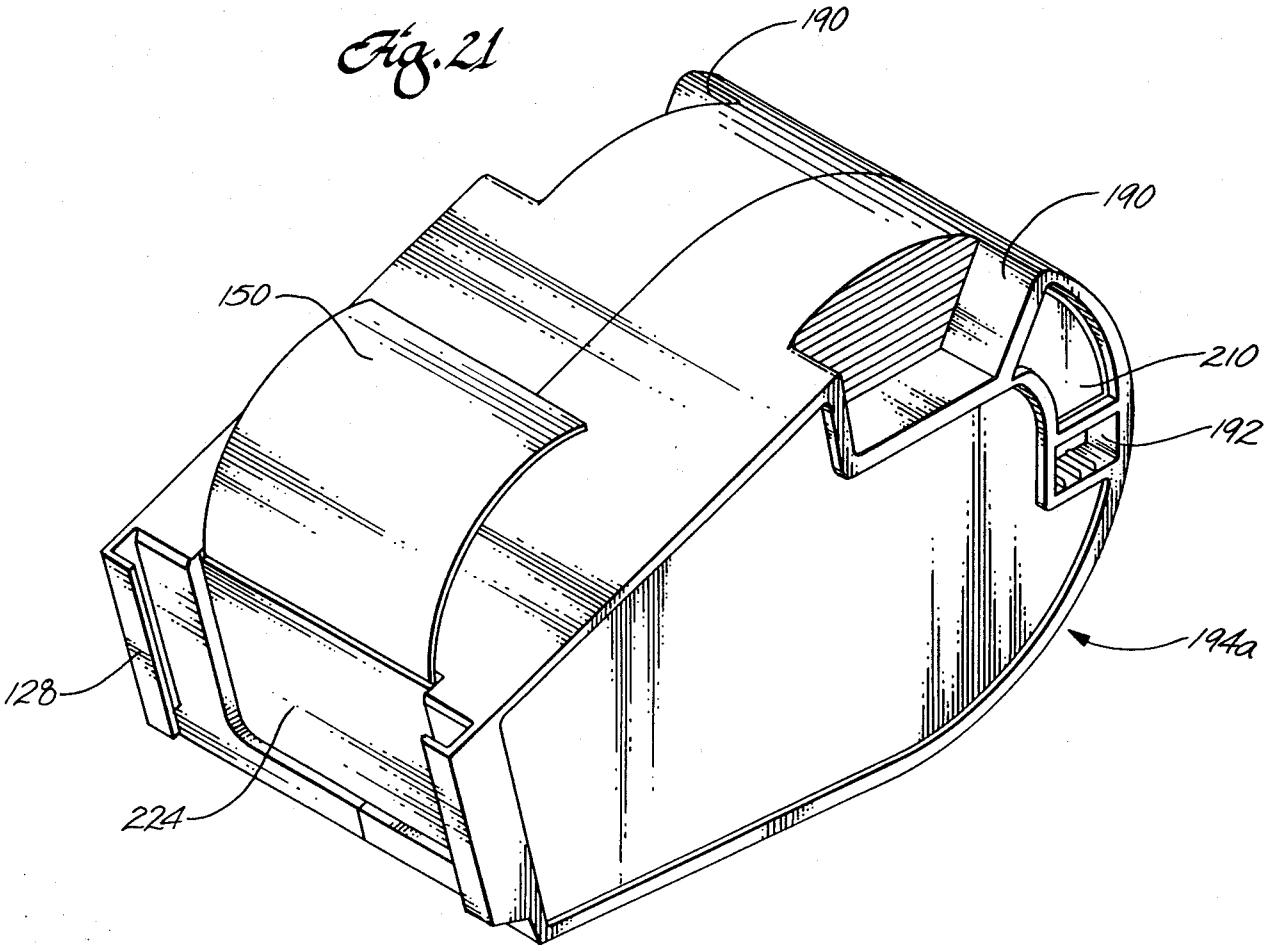
FIGS. 21–23 show a further embodiment of the tape cartridge of FIG. 18.
Figure 22:
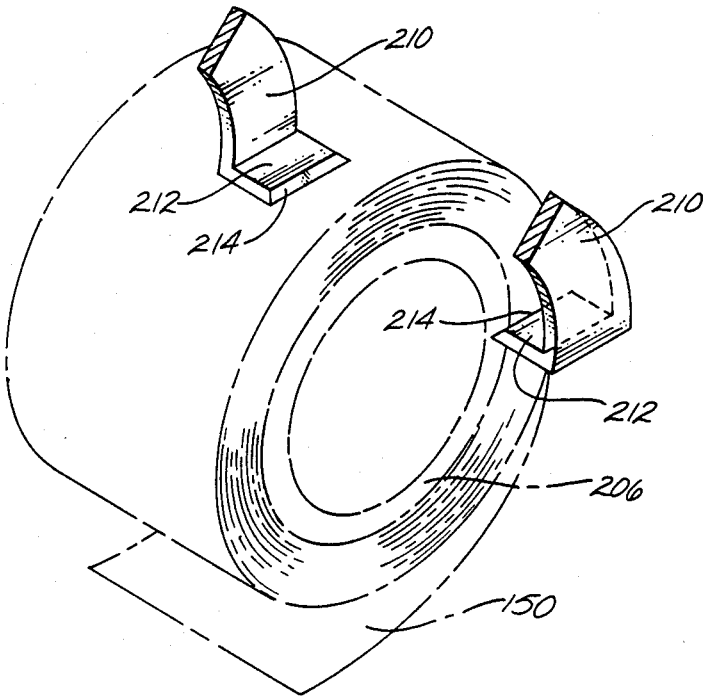
Figure 23:
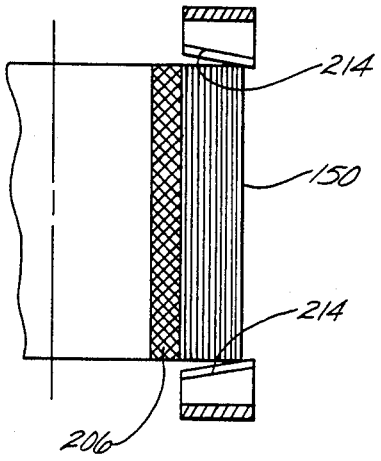

In a preferred embodiment, a frictional engagement mechanism in the form of pressure tabs 210 are formed on each side of the cartridge between the grips 190 and the tape length indicator 192, as shown in FIGS. 21–23. The pressure tabs are formed during the injection-molding process in each half of the tape cartridge to be biased inward when a tape roll is in place. Each pressure tab extends from the adjacent wall of the grip pocket arcuately along the side of the tape cartridge toward the tape length indicator. Each of the pressure tabs is preferably molded 10° inward relative to the side of the tape cartridge.

FIG. 22 shows each of the pressure tabs without each half of the tape cartridge with which they are integral. The roll of lettering tape is shown in phantom. FIG. 22 shows a flanged portion 212 for each pressure tab extending inwardly from the arcuate portion of the pressure tab to a beveled end 214 for contacting the respective edges of the lettering tape for producing a drag force on the tape roll to prevent the tape from unraveling. The pressure tabs also produce a drag force for increasing the force required to withdraw the tape from the tape cartridge.

As shown in FIG. 23, the entire length of the beveled edges do not contact respective sides of the tape roll. Each of the flanged portions 212 are trapezoidal in plan view and have a beveled edge nonparallel to the junction of the flanged portion and the arcuate portion. As a result, the pressure tab contacts the tape at a limited portion of the beveled edge so that the frictional engagement of the pressure tab with the lettering tape is localized. As the number of layers of lettering tape on the roll decreases, the pressure tabs move toward one another and contact the lettering tape at different locations on the beveled edges.

If the pressure tabs are omitted from the tape cartridge, significant unwinding of the lettering tape from the core does not occur, even when the tape is pulled back into the cartridge, as described more fully below.

Referring back to FIGS. 19 and 20, the tape extends from the tape roll to the dispenser slot 56. The tape is passed along a steel plate 224 mounted in the opening **224*a* (shown in FIG. 18) of the frame. The steel plate provides a rigid, smooth backing against which the tape is forced by pad 230, described below. The tape is passed between the steel plate and tape bias 226 mounted in the cartridge frame for biasing the tape in a second direction, indicated by arrow 228 opposite the direction in which the tape is pulled from the cartridge. The tape bias includes a discshaped pad 230 having a diameter of 0.630 inch extending substantially the minimum width of the pad opening 230*a* (FIG. 18). The pad opening is preferably trapezoidal with the top and bottom edges parallel and the side edges each extending outward from top to bottom 4° from the vertical. This shape allows the pad to slide freely in the opening and minimizes the possibility of one part of the pad applying a larger force than another part of the pad. In other words, this shape minimizes rotation of the pad as it moves in the opening. The pad is formed from any friction type material, such as santoprene, neoprene, rubber, polyvinylchloride, etc., such that the surface contacting the tape produces a frictional force preventing movement of the tape in either direction for a given force on the tape when the pad is stationary. The pad is able to move in a direction parallel to arrow 228 a distance 232 of preferably 0.225 inch. The pad is movable within a race 234 defined by the steel plate 224 and by pad opening 230a**.

The pad includes a mounting surface 238. The tape bias further includes a coil spring 240 mounted at a first end 242 to the top of the frame through a spring mounting pad 244. The first spring end is preferably mounted to the frame at least as high as the uppermost extent of travel of the pad in the race, as seen in FIG. 19. The second end of the spring 246 is coupled to the mounting surface 238 of pad 230.

The spring 246 preferably has a coil, each coil having an outside diameter of 0.375 inch. The coil is made from 0.030 inch diameter spring steel wire which has been single plated. The uncompressed length of the spring is preferably 1⅛ inches.

The tape bias frictionally engages the tape between the pad and the steel plate 224. When a force of approximately three pounds is applied to the end of the tape to pull the tape from the cartridge, the tape and pad travel through the race 234 until the pad reaches the uppermost extent of the race, adjacent the top of the frame. The tape is continually pulled from the cartridge when the force is being applied to the tape, for example, through rotation of the pressure rollers. When the force is removed from the end of the tape, the frictional engagement between the pad and tape and the spring bias produced by the coil 240 causes part of the tape to return into the cartridge a given distance. The pad moves downwardly along the race until it reaches the lowermost point of the race. In the preferred embodiment, the tape is pulled back a distance of 0.200 inch. However, this distance depends on the particular design of the machine, including the kerning adjuster. The tape pull back may be fixed or detachable with respect to the remainder of the apparatus for lettering tape.

An arcuate tape bearing surface 248 extends below the race downward and rearward toward the wall 93, the tape baffle 210 and the tape roll. The bearing surface preferably extends the width of the lettering tape. The surface guides the tape from the wall 93 to the steel plate 224 and beneath the pad 230 and provides an arcuate path for smoothing the turn of the tape toward the dispenser slot 56.

FIG. 20 shows the tape cartridge of FIG. 19 wherein the tape is under tension of a three pound force, for example, and wherein the pad is at the uppermost extent of travel in the race. As depicted in FIG. 20, the tape is under tension throughout the cartridge. The four guide stands and the tape baffle provide a counterforce against the force of pulling of the tape to keep the tape taut. The pad also provides a frictional force so that removal of the tape from the cartridge is relatively uniform. The pad, and generally the tape bias, serves two functions. The first function is to provide tape pull-back of a predetermined amount and the second is to limit return of the tape into the cartridge to the predetermined amount. The tape bias also serves to assist in frictionally engaging the tape to inhibit unraveling and to provide proper tensioning for letter forming. The pad and the guide posts each contribute to drag on the tape, much like stack rollers in assembly lines.

Consider now the operation of the apparatus with respect to the drawings. Typically, the apparatus for lettering tape is placed in a case 176 for protection and aesthetic design. A top (not shown) would be included as desired to protect the rollers, gears, and motor and to protect users. The tape supply is placed inside the case adjacent the small pressure roller 34 so that the small pressure roller is positioned between the tape supply and the flatted roller 32. As shown in FIG. 7, the lettering tape is taken from the tape supply and passed adjacent the small pressure roller from below rollers 32 and 34 between the rollers and pulled above both rollers. As a result, the lettering tape is exposed between the two rollers and can be fed from the tape supply out between the rollers to be grasped by the user if desired.

The die plate for the particular letter to be formed in the tape is placed between the flatted roller and the small pressure roller so that the tab indicating the letter of the die plate is facing the operator in a manner similar to that shown in FIG. 12. The letter B on the tab faces away from the small pressure roller 34 toward the large flatted roller 32. The die plate is passed between the rollers along the axis 126 and placed on ledge 122. The ledge and back 124 support the die plate so that the die plate extends along axis 126 between the rollers and extends above the rollers so that the operator may grasp the die plate and remove it if desired In this position, the label 156 on the die plate is adjacent the lettering tape and is between the rollers so that pressure is suitably applied by the rollers during operation to the die plate and lettering tape. A portion of the drive lugs 158 may also be between the rollers, depending upon the position of the kerning adjuster 110 along the axis 126. The die plate is placed so that the raised portion forming the letter will be immediately adjacent and contact the lettering tape as the rollers are operated.

The die plate and lettering tape are positioned with respect to the rollers and the kerning adjuster as indicated generally in FIG. 8. FIG. 8 is schematic only and not to scale and is shown for purposes of explanation. Though the label for the die plate and the entire portions of the drive lugs are not shown on the die plate of FIG. 8, it is to be understood that their location with respect to the rollers are such that the rotation of the rollers will pick up the die plate and the lettering tape to pull them through the gap between the rollers. The cutting portion of the letter on the die plate is preferably below the rollers sufficiently to allow the die plate and the lettering tape to be pulled through the gap a given amount before beginning formation of the letter in the lettering tape. The particular position of the letter "B" with respect to the roller and the preceding letter "A" will depend upon the desired spacing between the letter "A" and the new letter "B". This spacing, for a given lettering tape position, will depend upon the height of the kerning adjuster with respect to the rollers. By way of example, the kerning adjuster may be positioned as shown in FIG. 8 to correspond to a standard spacing.

Figure 8A:
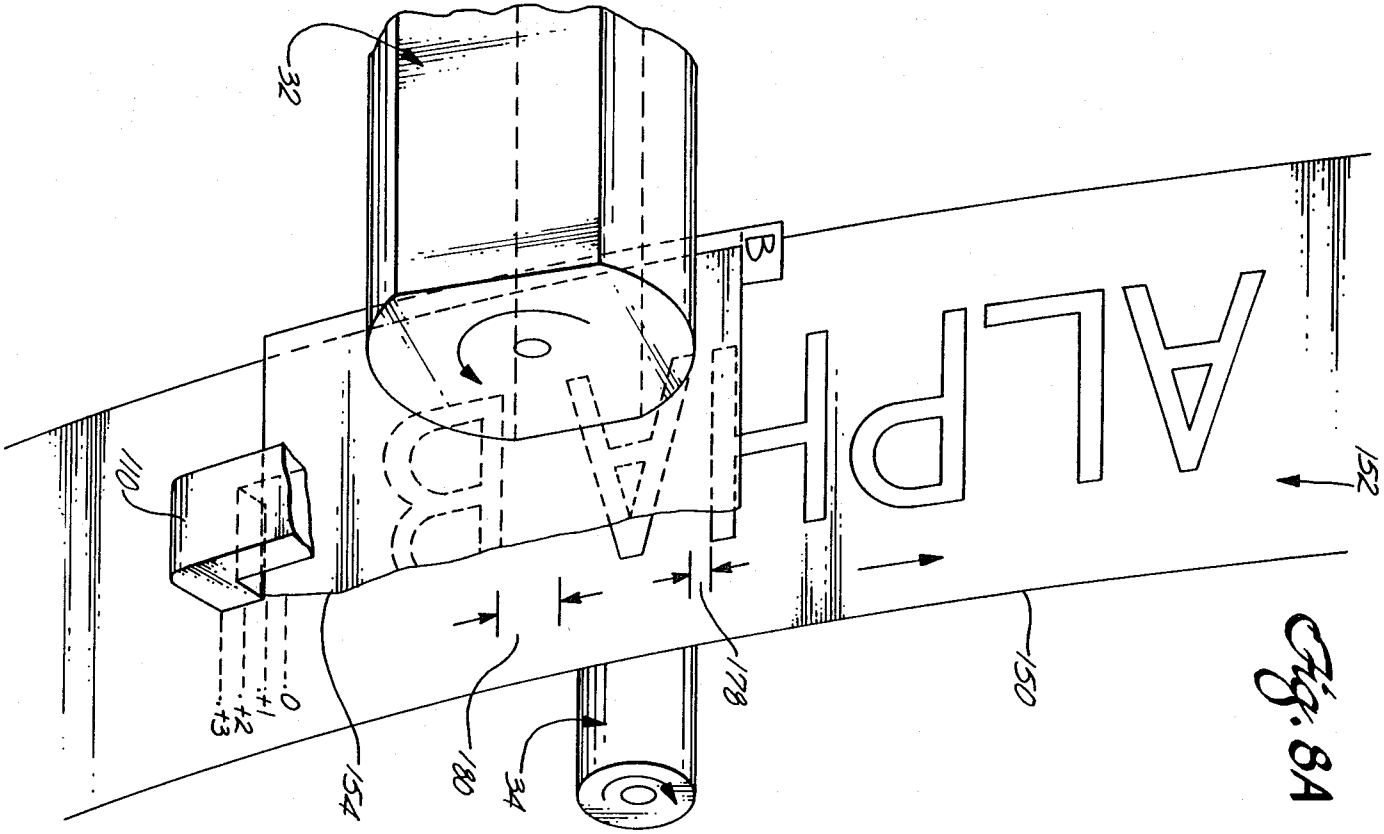

However, as shown in FIG. 8A, the kerning adjuster may be changed to the indicated position +1 so that the die plate is lower with respect to the pressure rollers than the position shown in FIG. 8. As a result, the cutting lines for the letter "B" are a distance below the rollers greater than that in FIG. 8. When the rollers begin to rotate in the directions shown in FIG. 8, it will take longer for the tape and cutting portion of the die plate to be positioned between the rollers to start. Therefore, if it is assumed that the distance 178 between the letter "H" and the letter "A" is the standard distance, then the letter spacing distance 180 may correspond to the spacing +1 indicated with respect to the kerning adjuster in FIGS. 7 and 8A. Therefore, for any given method of positioning the lettering tape with respect to the rollers, the spacing between each letter formed on the lettering tape may be determined by the relative position of the kerning adjuster with respect to the rollers. It should be noted that the positioning of the kerning adjuster assumes that the position of the cutting lines for a given letter is a constant with respect to the bottom edge of the die plate contacting the kerning adjuster and further assumes that the size and position of the label allows gripping of the die plate and lettering tape by the rollers regardless of the position of the kerning adjuster.

In the preferred embodiment, the kerning adjuster may be positioned as described above using the kerning knob so that the ledge 122 is positioned corresponding to the dots indicated as −2, −1, 0, +1, +2, and +3. This may be done by rotating the kerning knob so that the kerning shaft is positioned at corresponding dots −2, −1, 0, +1, +2 and +3. The significance of these numbers will be discussed more fully below. However, for present purposes, it will be assumed that the position of the kerning adjuster and the advancement of the lettering tape with respect to the die plate and the rollers will be the same for each letter. It will be assumed that the kerning adjuster is positioned at "0".

To initiate operation, the microswitch 174 is depressed through actuation of an appropriate actuator bar to supply current to the motor.

Once current is provided to the drive motor, the pinion gear drives the roller gears 74 and 82 such that the flatted roller rotates at approximately half the rotational speed of the small pressure roller. However, it should be noted that the effective diameter of the flatted pressure roller is slightly greater than the distance between the two opposing arcuate portions 66 and 68, due to the thickness of the die plate and the lettering tape. Therefore, the diameter of the small pressure roller has been designed to be slightly greater than half the diameter of the flatted pressure roller. This minimizes the possibility of wrinkling of the tape due to differences in linear velocity of the rollers, die plate, and lettering tape. The flatted pressure roller is made approximately twice the diameter, rather than approximately the same diameter, of the small pressure roller so that a lesser curvature is presented to the die plate to minimize rocking of the die plate as the die plate is pulled between the rollers.

When current is supplied to the motor, either through the microswitch or through the foot switch, the pinion gear drives the roller gears. The small pressure roller rotates along with the large flatted roller but without any movement of the die plate and lettering tape until such time as an arcuate portion of the flatted roller contacts the die plate at a point where a label exists on the die plate. At this point, the distance or gap between the pressure rollers is a minimum and a maximum of pressure is applied to the die plate and lettering tape. The application of pressure frictionally engages or grips the die plate and lettering tape together and advances them upwardly through the gap with minimum slipping between the rollers, die plate, and lettering tape. Because the lettering tape and die plate are advanced together, the relative spacing between the letter to be formed by the die plate and the immediately preceding letter is maintained constant.

When the arcuate portion contacts the die plate, movement of the die plate and lettering tape results from the thickness of the label, of the die plate and of the lettering tape. As the die plate, lettering tape, and rollers advance further, the drive lugs of the die plate come into play. The drive lugs push the rollers apart a distance to preload the pressure rollers with a force proportional to the distance the rollers are spread from their normally free state. This preloading is in addition to the preloading achieved through the spacer and adjust bolt. Once the rollers are preloaded, the formation of the letter in the tape is better.

There is a point where the cutting lines of the particular letter on the die plate are pressed between the rollers. This point is typically not the same as the point at which the drive lugs come between the rollers nor where the prespace begins. The prespace begins at the point where the rollers pick up the tape and die plate and ends where the leading edge of the letter occurs. As shown in FIGS. 9 and 9A, the arcuate portion of the flatted roller in contact with the die plate, the die plate and the lettering tape have advanced to a point where formation of the letter from the die plate into the lettering tape has begun. The tape and the die plate have been pulled between the rollers and extend an appropriate distance out of the gap between the rollers.

During the formation of the letter, the cutting lines of the die plate are pressed against the lettering tape and form a letter as described in the previously-mentioned U.S. patents.

It is possible that the thickness of the die plate due to the label, the drive lugs, or the cutting lines of the letter and due to the thickness of the lettering tape would cause the cutting lines on the die plate to press too far into the lettering tape. This possibility is minimized by the spring nature of the side plates supporting the rollers. The spring-tensioned side plates and the spacing between the spring ends of the side plates are formed so that any excessive thickness of the die plate or lettering tape is accommodated by the changing of the distance in the gap between the rollers. In the typical case, imperfect letter formation due to imperfections in the die plate or in the lettering tape will be negated or minimized by the tolerance allowed through the spring-tensioned side plates so that the lettering tape is not damaged by the cutting lines on the die plate.

It is believed that the spring end 60 (FIG. 5) moves with respect to the base to a greater extent than the spring end 58. Additionally, the spreading of the spring ends is only great enough to allow passage of the die plate and lettering tape without damage to the lettering tape. The adjuster screw and saddle 92 are still positioned between the spring ends so that the spring ends return to their original position on each side of the plate adjuster. If the increased thickness is a result of imperfections in the tape, the same spreading of the ends may occur during the formation of subsequent letters However, the spreading of the ends may or may not re-occur with other die plates if the imperfection was due to the die plate just used.

The rollers will continue to rotate even though the operator may have removed pressure from the actuator switch. This results from contact of an axle 182 of the flatted roller 32 extending beyond the bushing 84 (FIG. 1). The axle includes flatted portions 184 and arcuate portions 186. The arcuate portions contact a bearing surface 188 of the microswitch 174 for depressing the microswitch while the die plate and lettering tape are advancing. Depression of the microswitch 174 maintains the direct current to the motor which was initiated by depression by the operator of the actuator switch or foot switch. As the rollers continue to rotate, the die plate and lettering tape are further advanced through the gap to a point above the rollers. Formation of the letter on the lettering tape also continues. When the formation of the letter is complete, rotation of the rollers and advancement of the tape will continue until the end of the label, i.e. the end of the post space reaches the pressure rollers. Because the combined thickness of the die plate and tape is less at the end of the label, the frictional engagement needed for advancement of the die plate and the lettering tape is eliminated. Eventually, the rotation of the rollers stops due to release of the bearing surface 188 on the microswitch from the flatted portion on the axle. Since the motor 78 is a D.C. motor, the rotation of the rollers is stopped by ground braking of the motor rather than through mechanical braking of the rollers with a frictional brake. In the preferred embodiment, the flatted portion of the roller stops immediately opposite the small pressure roller.

Depending upon the design, the lettering tape may be maintained in the same position as when the rotation of the rollers stopped or may be retracted back through the gap toward the tape supply. In the preferred embodiment, the tape is retracted a given amount by the tape pullback. The control of the tape is described more fully in the copending application.

An additional letter may be formed in the lettering tape by repeating the same process. The same die plate may be used, or a die plate for a different letter may be substituted, and the process repeated. Additionally, the spacing of the next letter may be adjusted by turning the kerning knob for moving the kerning adjuster upward or downward with respect to the rollers as seen in FIG. 7. If the kerning adjuster is moved downward, the spacing between the new letter and the immediately preceding letter is increased due to the additional movement of the tape and die plate between the rollers required before a letter is formed in the lettering tape. In other words, the prespace is increased.

If the rollers need to be cleared, the switch S1 may be activated to the momentary reverse position so that the rollers are rotated in the reverse directions with the D.C. motor.

The spacing of the individual letters will now be described with respect to FIGS. 7, 8, 8A, and 11A–11F. In previous designs, the tape was supplied to the gap between the rollers from a spool mounted in the frame and including slip clutch discs to provide drag for the tape as it was pulled out. The die plate was supported and moved with respect to the tape and rollers with a spacing adjuster. If standard spacing was desired, the die plate was supported at a position analogous to the standard position for the kerning adjuster 110. This provided a minimum spacing of 0.005 inch. If the die plate was positioned lower with respect to the rollers so that the prespace is increased, the spacing between letters is increased. For example, if the kerning adjuster was lowered to the position indicated at +1 in FIG. 8, the spacing between the next letter to be formed and the immediately preceding letter would be 0.070 inch. If the kerning adjuster were further lowered so that the ledge were positioned at the point indicated as +2, the spacing between the two letters would be 0.135 inch. For the position identified as +3, the spacing would be 0.200 inch (0.225 in the preferred embodiment). It is to be understood that the spacing between all letters in a given word need not be the same. For example, the word in FIGS. 11A–11F could be formed so that the spacing between the letters "W" and "A" would be less than the spacing between the letters "A" and "L".

In the preferred embodiment, the standard position of the kerning adjuster is 0.225 inch below the standard position in prior devices. Additionally, the tape supply retracts the lettering tape 0.225 inch at the end of each letter-forming cycle when the die plate and lettering tape are released. Therefore, the tape is drawn back 0.225 inch into the gap between the rollers at the end of each cycle. As a result of this change in design, the tape and die plate are pulled 0.225 inch further through the gap than before prior to the beginning formation of the letter.

For letters formed with spacings corresponding to 0, 1, +2 or +3, there is no net change in the apparatus. If it is desired to start the succeeding letter on the lettering tape further away from the preceding letter, i.e. increase the interletter spacing, the kerning adjuster is lowered to one of the positive numbered positions. This drops the die plate to a position even lower than the standard position ("0" in FIGS. 7 and 8). As a result, the prespace is increased and the letter forming process starts by picking up the die plate at a point on the die plate further away from the letter on the die plate. Specifically, as the pressure rollers turn, the surfaces of the rollers come together and grasp the lettering tape and die plate at a point closer to the top of the die plate than would have occurred with the die plate positioned at "0". The letter is finally formed closer to the end of the rotation cycle of the rollers than is the case where the kerning adjuster is closer to the pressure rollers (i.e. at "0"). However, if the kerning adjuster is raised from the new standard position (i,.e., is less than 0.225 inch from the standard position of the prior lettering machine) while the lettering tape is still pulled back or retracted the full 0.225, prespace is less than if the kerning adjuster was positioned at "0" and the starting point of the next succeeding letter is even closer to the trailing edge of the next preceding letter. As a result, the beginning of the rotation cycle of the rollers picks up the die plate and lettering tape at a point closer to the letter on the die plate. The letter-forming process begins on the lettering tape closer to the previous letter. When the end of the label is reached, the lettering tape is again retracted 0.225 inch and the die plate again falls to the kerning adjuster or is removed by the user.

Figure 11A:
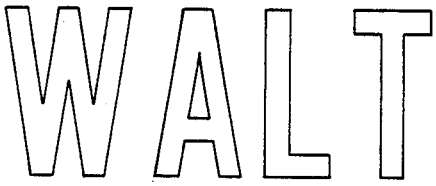
FIGS. 11A–11F show possible spacing distances between individual letters to e formed on a tape.
Figure 11B:
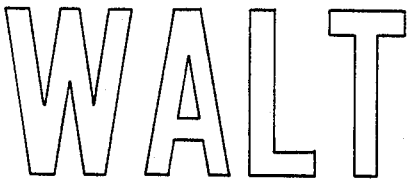
Figure 11C:
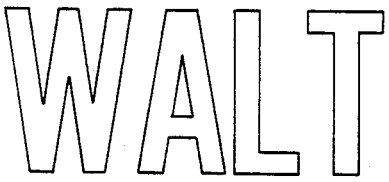
Figure 11D:
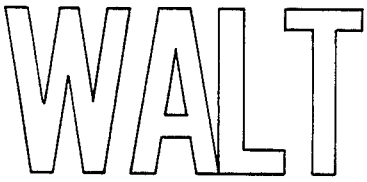
Figure 11E:
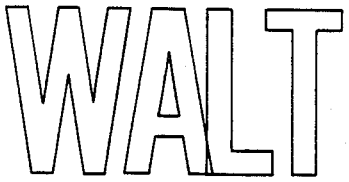
Figure 11F:
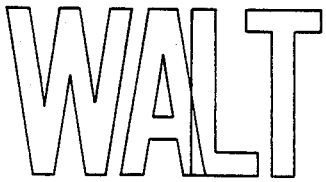

It is significant that the tape supply retracts the lettering tape after each letter-forming cycle. Without the retraction step, the tape would stay at its final location at the end of the rotation cycle of the rollers. Then, the formation of the next letter would start that much further along the lettering tape away from the previously formed letter. The preferred design allows for what is considered negative spacing. It allows overlap between adjacent letters. The overlap can be seen between the "W" and the "A" in FIGS. 11E and 11F. Therefore, if the tape is pulled back 0.225 inch after formation of the preceding letter, and the kerning adjuster is positioned only 0.140 inch below what used to be the standard position for the die plate, a negative spacing of −0.060 inch between adjacent letters can be accomplished. This spacing corresponds to the −1 in FIGS. 7 and 11E. As can be seen in FIG. 11E, the negative pacing is appropriate between the letters "W" and "A" and between the letters "L" and "T". However, negative spacing is not appropriate for the spacing between the letters "A" and "L". Similar comments can be made with respect to other combinations of letters. Therefore, for any given constant tape pullback, adjustment of the kerning adjuster may give either positive or negative spacing between adjacent letters so that there appears to be uniform spacing between adjacent letters in a given word. Standards may be defined for spacing between any pair of letters, so that, for example, the spacing between "W" and "A" is always the same and appears to be the same as the spacing between "A" and "L". For example, the spacing between "W" and "A" may be −2 and the spacing between "A" and "L" may be +1. Additionally, the typical spacing between "L" and "T" may be −2.

It should be noted that the above are preferred configurations but others are foreseeable. The described embodiments of the invention are only considered to be preferred and illustrative of the inventive concept. Scope of the invention is not to be restricted to such embodiments. Various and numerous other arrangements may be devised by one skilled in the art without departing from the spirit and scope of the invention.

For example, other types of roller drives other than a D.C. motor can be used. Additionally, the dimensions of the rollers may be changed if some wrinkling of the tape can be tolerated. The form and dimensions of the side plates can also be changed as desired. For example, other types of metals can be used or the number of laminates can be varied to provide the desired pretension strength. Furthermore, the adjustment bolt for the side plates can be designed in other ways as long as means are provided for counteracting the biasing forces of the spring ends of the side plates. Finally, the particular shape of the spring ends and of the side plates in general can be varied to accommodate the arrangement of rollers and a base. However, it is significant to allow separation of the rollers as a result of variations in thickness of the die plate or lettering tape.

The kerning adjuster can be modified according to appropriate changes in the orientation of the rollers and the base to provide appropriate support for the die plate and to provide adjustment of the vertical position of the die plate with respect to the rollers. Additionally, means other than the kerning knob may be used to adjust the kerning adjuster. The preferred 15° angle of insertion for the die plate can also be different, if desired.

Other means for feeding and supporting lettering tape may be used in place of the tape supplying means described in the copending application. Though previous tape supply means do not provide for tape pullback, positive spacing of the letters can still be accomplished with the lettering apparatus as described herein with a simple roll of tape on a spool in the case 176. Other friction means may also be employed to provide tape tension and to prevent unraveling. If the pressure tabs are omitted, the lettering tape would not loosen an appreciable amount from the roll. Additionally, other die guide means may be employed.

Finally, other arrangements for making the individual lamina for the side plates would be clear to one skilled in the art. Additionally, other circuits may be devised for driving the rollers as would also be obvious to one skilled in the art based on the disclosure herein.

What is claimed is:

1. Apparatus for forming indicia in a type comprising:

spring means having curved arms terminating in closely spaced end faces defining a gap between said end faces;

a pair of rollers each having a longitudinal axis and roller surfaces, said rollers being supported on the spring means with their axes disposed in parallel relation to each other and the surfaces of the rollers disposed adjacent each other;

spacer means located in the gap to selectively separate the end faces and impart a force opposed to the normal bias of the spring means, die plate means positionable between the rollers;

means for placing the tape between the die plate means and one of said rollers;

means for causing the rollers to rotate and pull the die plate and tape through the rollers to form an indicia on the tape; and means for retracting the tape a short distance after one or more indicia has been formed on the tape.

2. The apparatus of claim 1 wherein the rotating means is arranged to rotate the rollers in a first direction for advancing the tape and in a second direction for reversing the direction of movement of the tape.

3. The apparatus as claimed in claim 1 further comprising a tape cartridge including tape biasing means for retracting the tape into the cartridge and means for producing tension in said tape.

4. The apparatus of claim 1 wherein a pair of springs are provided on opposite ends of the rollers.

5. The apparatus of claim 4 wherein each spring comprises at least one plate, the plate being provided with apertures positioned adjacent the end faces on opposite sides of the gap, said apertures being adapted to receive bushings for mounting the rollers between the springs.

6. The apparatus of claim 5 wherein the springs comprise a plurality of laminated plates.

7. The apparatus of claim 6 wherein the laminated plates of each spring are bonded together.

8. The apparatus of claim 1 in which the spacer means comprises a wedge located in the gap between the end faces of at least one spring, said wedge including means for adjusting the position of the wedge with respect to the end faces of the spring.

9. The apparatus of claim 8 wherein the wedge contacts the surfaces of the end faces of the spring which are divergent with respect to each other.

10. The apparatus of claim 1 further including a direct current motor for rotating the rollers with respect to each other.

11. The apparatus of claim 10 wherein an end of one roller comprises a flat and wherein the apparatus further includes a switch for interrupting current to the motor when the flat reaches the switch.

12. The apparatus of claim 11 wherein the first roller is stationary when a flat is oriented at 15° with respect to a vertical axis through the apparatus.

13. The apparatus of claim 10 further comprising means for electrically coupling the motor to a 12 volt power supply.

14. The apparatus of claim 1 wherein the pair of rollers comprises a first roller and a second roller and wherein the diameter of the first roller is less than twice the diameter of the second roller.

15. The apparatus of claim 14 wherein a pair of flats are located on diametrically opposed sides of the first roller.

16. The apparatus of claim 14 wherein each roller comprises gear means dimensioned in the ratio of 2:1.

17. The apparatus of claim 1 further including means for supporting a die plate between the rollers.

18. The apparatus of claim 17 wherein the die plate supporting means is adjustable for adjusting the position of the die plate relative to the rollers.

19. A method for lettering tape using a lettering machine with two rollers spring-biased towards one another, a die plate and lettering tape, the method comprising the steps of:

providing the rollers on a spring having curved arms terminating in closely spaced end faces defining a gap therebetween;

providing spacer means located in the gap to selectively separate the end faces and to impart a counterforce to the normal bias of the spring;

placing the die plate between the rollers;

placing the tape between the die plate and one of the rollers;

causing the rollers to rotate such that the die plate and tape are pulled between the rollers for forming a letter in the tape; and pulling the tape in a reverse direction away from the rollers.

20. The method as claimed in claim 19 wherein the lettering tape is fed at an angle of about 15° with respect to a vertical axis through the machine and further including the step of adjusting the position of the die plate relative to the rollers to adjust the spacing between letters formed in the tape.

21. The method as claimed in claim 20 wherein the step of adjusting the position of the die plate relative to the rollers comprises raising the die plate between the rollers for decreasing the spacing between letters formed in the tape.

22. The method as claimed in claim 20 wherein the step of adjusting the position of the die plate relative to the rollers comprises lowering the die plate between the rollers for increasing the spacing between letters formed in the tape.

23. The method as claimed in claim 19 wherein the step of pulling in a reverse direction the tape comprises the step of pulling the tape approximately 0.225 inch.

24. The method as claimed in claim 19 further comprising the step of inserting a cartridge containing the tape so that the tape extends between the rollers.

* * * * *

UNITED STATES PATENT AND TRADEMARK OFFICE

CERTIFICATE OF CORRECTION

PATENT NO. : 4,867,056

DATED : September 19, 1989

INVENTOR(S) : J.B. Anderson; J. de Gelder

It is certified that error appears in the above-identified patent and that said Letters Patent is hereby corrected as shown below:

On the Front Page:

[75] Inventor; change "J. Becker" to -- J. Becher --.

In the Specification

Column 3, line 15, change "define" to -- defined --.
Column 4, line 56, change "e" to -- be --.
Column 6, line 14, change "mall" to -- small --.
Column 8, line 16, change "on" to -- to --.
Column 8, line 17, delete "with respect to the rollers".
Column 8, line 55, change "06/895" to -- 06/895,744 --.
Column 9, line 7, change "11" to -- 112 --.
Column 9, line 25, after "146" insert a comma.
Column 16, line 21, after "desired" insert a period.
Column 18, line 52, after "letters" insert a period.

In the Claims

Column 21, line 62, change "type" to -- tape --.

Signed and Sealed this

First Day of October, 1991

*Attest:*

HARRY F. MANBECK, JR.

*Attesting Officer*

*Commissioner of Patents and Trademarks*